US005900896A

United States Patent [19]

Barinaga et al.

[11] Patent Number: 5,900,896

[45] Date of Patent: May 4, 1999

[54] INK CARTRIDGE ADAPTERS

[75] Inventors: John A. Barinaga; Bruce Cowger, both of Corvallis, Oreg.

[73] Assignee: Hewlett-Packard Company, Palo Alto, Calif.

[21] Appl. No.: 08/566,818

[22] Filed: Dec. 4, 1995

Related U.S. Application Data

[63] Continuation-in-part of application No. 08/429,915, Apr. 27, 1995, Pat. No. 5,825,387.

[51] Int. Cl.[6] ..... B41J 2/175; B41J 2/18

[52] U.S. Cl. ..... 347/86; 347/89; 347/87

[58] Field of Search ..... 347/86, 85, 84, 347/87, 49, 89, 92

[56] References Cited

U.S. PATENT DOCUMENTS

| | | | |
|---|---|---|---|
| 4,253,103 | 2/1981 | Heinzl . | |
| 4,303,929 | 12/1981 | Blanck | 346/140 R |
| 4,558,326 | 12/1985 | Kimura . | |
| 4,568,954 | 2/1986 | Rosback | 346/140 R |
| 4,593,294 | 6/1986 | Parisi . | |
| 4,623,905 | 11/1986 | Ichibashi . | |
| 4,628,334 | 12/1986 | Dagna et al. | 346/140 R |
| 4,831,389 | 5/1989 | Chan . | |
| 4,999,652 | 3/1991 | Chan . | |
| 5,119,115 | 6/1992 | Buat . | |
| 5,343,226 | 8/1994 | Niedermeyeyr . | |
| 5,359,356 | 10/1994 | Ecklund . | |
| 5,359,357 | 10/1994 | Takagi et al. | 347/49 |
| 5,365,260 | 11/1994 | Kitani . | |
| 5,406,320 | 4/1995 | Durst . | |

FOREIGN PATENT DOCUMENTS

| | | | |
|---|---|---|---|
| 58108153 | 6/1983 | European Pat. Off. . | |
| 02003310 | 8/1990 | European Pat. Off. | B41J 2/175 |
| 0444261A1 | 12/1990 | European Pat. Off. | B65D 33/01 |
| 0 560 729 A2 | 3/1993 | European Pat. Off. | B41J 2/175 |
| 0603516A2 | 11/1993 | European Pat. Off. | B41J 2/175 |
| 0672527A2 | 8/1994 | European Pat. Off. . | |
| 604922 | 2/1994 | Japan . | |
| 578944 | 12/1976 | Switzerland | B41J 3/04 |

*Primary Examiner*—Peter S. Wong
*Assistant Examiner*—Rajnikant B. Patel

[57] ABSTRACT

A reservoir for an ink supply for an ink-jet printer is provided with a refill port through which it can be refilled. The reservoir may be coupled to a variable volume chamber via a check valve which allows the flow of ink from the reservoir to the chamber and limits the flow of ink from the chamber to the reservoir. The chamber is coupled to a fluid outlet which is normally closed to prevent the flow of ink. However, when the ink supply is installed in a printer, the fluid outlet establishes a fluid connection between the chamber and the printer. The chamber is part of a pump provided with the ink supply that can be actuated to supply ink from the reservoir to the printer. Alternatively, the reservoir may be coupled directly to the fluid outlet and an alternative method of transferring the ink to the printer provided.

17 Claims, 15 Drawing Sheets

INK CARTRIDGE ADAPTERS

CROSS RELATED APPLICATIONS

This application is a continuation-in-part of U.S. patent application Ser. No. 08/429,915, entitled "Ink Supply For An Ink-Jet Printer" filed Apr. 27, 1995, attorney docket number 1094053-2, now U.S. Pat. No. 5,825,387.

BACKGROUND OF THE INVENTION

1. Field of the Invention

The present invention relates to ink supplies for an ink-jet printer and, more particularly to ink supplies that can be readily refilled or replenished.

2. Description of Related Art

A typical ink-jet printer has a print head mounted to a carriage which is moved back and forth over a printing surface, such as a piece of paper. As the print head passes over appropriate locations on the printing surface, a control system activates ink jets on the print head to eject, or jet, ink drops onto the printing surface and form desired images and characters.

To work properly, such printers must have a reliable supply of ink for the print head. Many ink-jet printers use a disposable ink pen that can be mounted to the carriage. Such an ink pen typically includes, in addition to the print head, a reservoir containing a supply of ink. The ink pen also typically includes pressure regulating mechanisms to maintain the ink supply at an appropriate pressure for use by the print head. When the ink supply is exhausted, the ink pen is disposed of and a new ink pen is installed. This system provides an easy, user friendly way of providing an ink supply for an ink-jet printer.

Other types of ink-jet printers use ink supplies that are separate from the print head and are not mounted to the carriage. Such ink supplies, because they are stationary within the printer, are not subject to all of the size limitations of an ink supply that is moved with the carriage. Some printers with stationary ink supplies have a refillable ink reservoir built into the printer. Ink is supplied from the reservoir to the print head through a tube which trails from the print head. Alternatively, the print head can include a small ink reservoir that is periodically replenished by moving the print head to a filling station at the stationary, built-in reservoir. In either alternative, ink may be supplied from the reservoir to the print head by either a pump within the printer or by gravity flow.

Still other ink-jet printers use replaceable reservoirs that are separate from the print head. These reservoirs, like the built-in reservoirs are not located on the carriage and, thus, are not moved with the print head during printing. Replaceable reservoirs are often plastic bags filled with ink. The bag is provided with a mechanism, such as a septum which can be punctured by a hollow needle, for coupling it to the printer so that ink may flow from the bag to the print head. Often, the bag is squeezed, or pressurized in some other manner, to cause the ink to flow from the reservoir.

Once depleted, the reservoir is typically discarded and a new reservoir installed. However, the reservoir and any associated mechanisms are typically capable of further use if they could be replenished with a fresh supply of ink.

SUMMARY OF THE INVENTION

Accordingly, it is an object of the present invention to provide an ink supply for an ink-jet printer that can be readily refilled or replenished and that provides a reliable supply of ink for a print head.

It is a further object of the invention to provide an ink supply that can be refilled or replenished easily and efficiently.

It is a further object of the invention to provide an ink supply for an ink-jet printer that is cost-effective, environmentally friendly, limits waste and more efficiently uses components of the ink supply.

An ink supply in accordance with one aspect of the present invention has a main reservoir for holding a supply of ink. The main reservoir can be coupled to a pump to supply ink from the reservoir to the printer. The pump may include a variable volume chamber and a check valve such that when the volume of the chamber is increased, ink is drawn from the reservoir through the valve and into the chamber. When the volume of the chamber is decreased ink is forced from the chamber to supply ink through a fluid outlet that is coupled with a fluid inlet on the printer and to the print head. A refill port sealed with a removable cap defines a fluid path into the reservoir. In this manner, when ink is depleted from the reservoir, the cap can be removed and additional ink added to the reservoir.

In another aspect of the invention, the ink supply may include an adapter which carries the pump, the fluid outlet, and a receptacle in fluid communication with the pump. A replaceable or refillable reservoir can be removably coupled to the receptacle by, for example, a threaded connection or a trailing tube. In this manner, when the reservoir is depleted it can be removed from the adapter and either replaced or refilled allowing the continued use of the adapter and the components it carries.

In yet another aspect of the invention, the adapter need not have pump. Rather, the receptacle can be provided in fluid communication with the fluid outlet and an alternative to the pump, such as gravity flow, capillary action, or pressurization of the reservoir itself, can be used to supply ink from the reservoir to the print head.

Other objects and aspects of the invention will become apparent to those skilled in the art from the detailed description of the invention which is presented by way of example and not as a limitation of the present invention.

DESCRIPTION OF THE ILLUSTRATED EMBODIMENT

Figure 1:
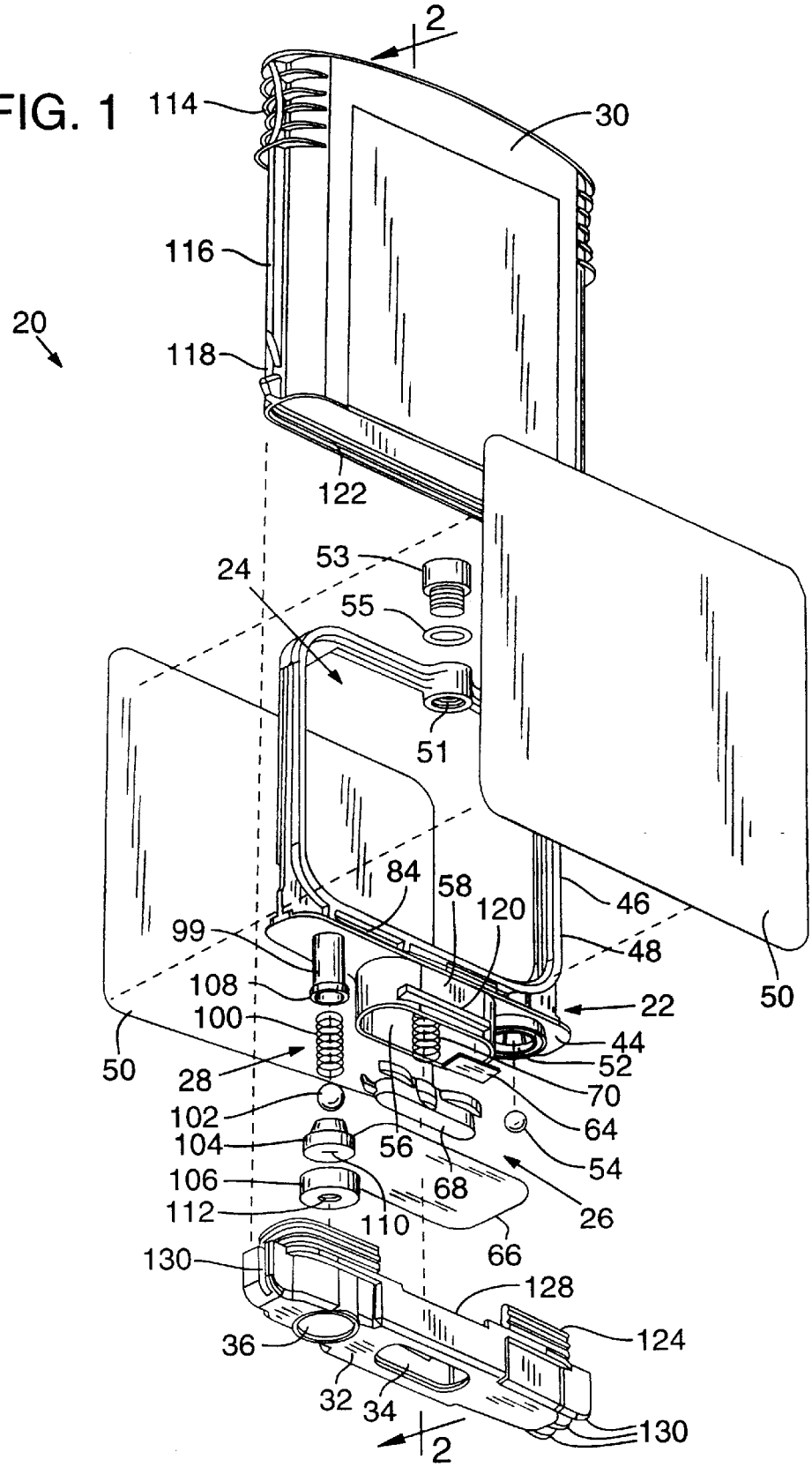
FIG. 1 is an exploded view of an ink supply in accordance with a preferred embodiment of the present invention.

An ink supply in accordance with a preferred embodiment of the present invention is illustrated in FIG. 1 as reference numeral 20. The ink supply 20 has a chassis 22 which carries an ink reservoir 24 for containing ink, a pump 26 and fluid outlet 28. The chassis 22 is enclosed within a hard protective shell 30 having a cap 32 affixed to its lower end. The cap 32 is provided with an aperture 34 to allow access to the pump 26 and an aperture 36 to allow access to the fluid outlet 28.

To use the ink supply 20, it is inserted into a docking bay 38 of an ink-jet printer, as illustrated in FIGS. 7–10. Upon insertion of the ink supply 20, an actuator 40 within the docking bay 38 is brought into contact with the pump 26 through aperture 34. In addition, a fluid inlet 42 within the docking bay 38 is coupled to the fluid outlet 28 through aperture 36 to create a fluid path from the ink supply to the printer. Operation of the actuator 40 causes the pump 26 to draw ink from the reservoir 24 and supply the ink through the fluid outlet 28 and the fluid inlet 42 to the printer.

Upon depletion of the ink from the reservoir 24, or for any other reason, the ink supply 20 can be easily removed from the docking bay 38. Upon removal, the fluid outlet 28 and the fluid inlet 42 are closed to help prevent any residual ink from leaking into the printer or onto the user. The ink supply may then be easily refilled, replenished or stored for reinstallation at a later time. In this manner, the present ink supply 20 provides a user of an ink-jet printer a simple, economical way to provide a reliable, and easily replaceable supply of ink to an ink-jet printer.

As illustrated in FIGS. 1–4, the chassis 22 has a main body 44. Extending upward from the top of the chassis body 44 is a frame 46 which helps define and support the ink reservoir 24. In the illustrated embodiment, the frame 46 defines a generally square reservoir 24 having a thickness determined by the thickness of the frame 46 and having open sides. Each side of the frame 46 is provided with a face 48 to which a sheet of plastic 50 is attached to enclose the sides of the reservoir 24. The illustrated plastic sheet is flexible to allow the volume of the reservoir to vary as ink is depleted from the reservoir. This helps to allow withdrawal and use of all of the ink within the reservoir by reducing the amount of backpressure created as ink is depleted from the reservoir. The illustrated ink supply 20 is intended to contain about 30 cubic centimeters of ink when full. Accordingly, the general dimensions of the ink reservoir defined by the frame are about 57 millimeters high, about 60 millimeters wide, and about 5.25 millimeters thick. These dimensions may vary depending on the desired size of the ink supply and the dimensions of the printer in which the ink supply is to be used.

A refill port 51 is formed in the top of the frame 46. The refill port provides a fluid path through which ink can be introduced to fill or to refill the reservoir. A removable cap 53 closes the refill port. In the illustrated embodiment, the cap is threaded and is provided with an o-ring 55 to ensure a leak-proof seal. However, other types of caps could also be used so long as they allow refilling of the ink reservoir and limit the ingress of air and the egress of ink from the reservoir.

In the illustrated embodiment, the plastic sheets 50 are heat staked to the faces 48 of the frame in a manner well known to those in the art. The plastic sheets 50 are, in the illustrated embodiment, multi-ply sheets having a an outer layer of low density polyethylene, a layer of adhesive, a layer of metallized polyethylene terephthalate, a layer of adhesive, a second layer of metallized polyethylene terephthalate, a layer of adhesive, and an inner layer of low density polyethylene. The layers of low density polyethylene are about 0.0005 inches thick and the metallized polyethylene terephthalate is about 0.00048 inches thick. The low density polyethylene on the inner and outer sides of the plastic sheets can be easily heat staked to the frame while the double layer of metallized polyethylene terephthalate provides a robust barrier against vapor loss and leakage. Of course, in other embodiments, different materials, alternative methods of attaching the plastic sheets to the frame, or other types of reservoirs might be used.

The body 44 of the chassis 22, as seen in FIGS. 1–4, is provided with a fill port 52 to allow ink to be introduced into the reservoir. After filling the reservoir, a plug 54 is inserted into the fill port 52 to prevent the escape of ink through the fill port. In the illustrated embodiment, the plug is a polypropylene ball that is press fit into the fill port. In alternative embodiments, the fill port may be unnecessary as the reservoir may be filled through the refill port.

A pump 26 is also carried on the body 44 of the chassis 22. The pump 26 serves to pump ink from the reservoir and supply it to the printer via the fluid outlet 28. In the illustrated embodiment, seen in FIGS. 1 and 2, the pump 26 includes a pump chamber 56 that is integrally formed with the chassis 22. The pump chamber is defined by a skirt-like wall 58 which extends downwardly from the body 44 of the chassis 22.

A pump inlet 60 is formed at the top of the chamber 56 to allow fluid communication between the chamber 56 and the ink reservoir 24. A pump outlet 62 through which ink may be expelled from the chamber 56 is also provided. A valve 64 is positioned within the pump inlet 60. The valve 64 allows the flow of ink from the ink reservoir 24 into the chamber 56 but limits the flow of ink from the chamber 56 back into the ink reservoir 24. In this way, when the chamber is depressurized, ink may be drawn from the ink reservoir, through the pump inlet and into the chamber. When the chamber is pressurized, ink within the chamber may be expelled through the pump outlet.

Figure 2:
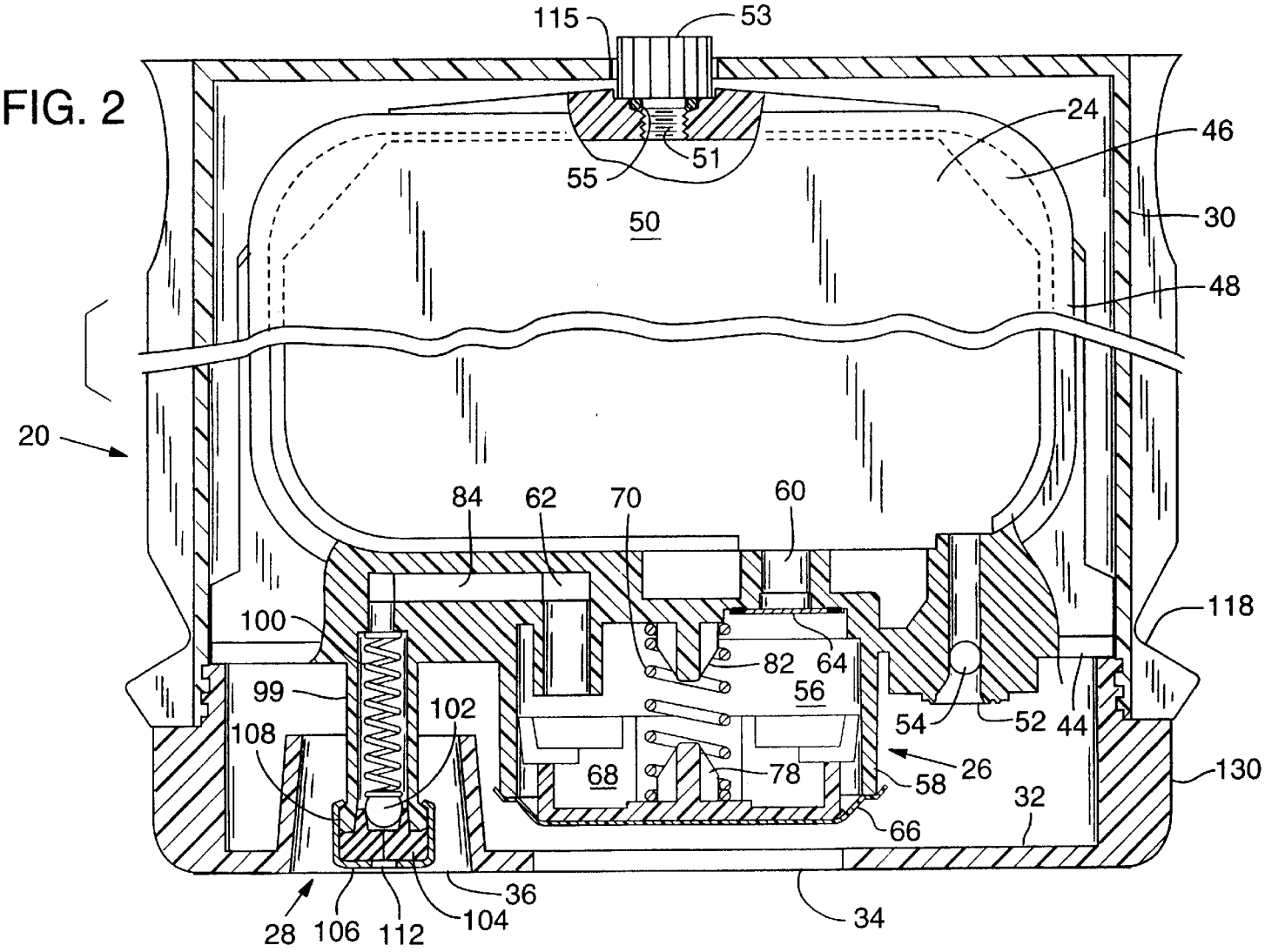
FIG. 2 is cross sectional view, taken along line 2—2 of FIG. 1, of a portion of the ink supply of FIG. 1.
Figure 3:
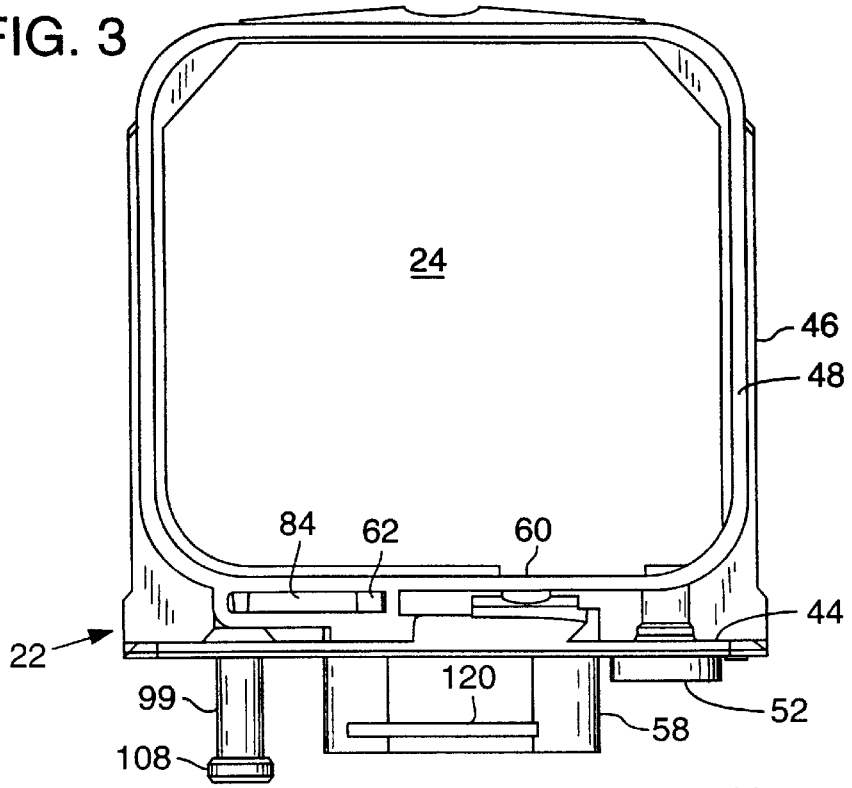
FIG. 3 is a side view of the chassis of the ink supply of FIG. 1.
Figure 4:
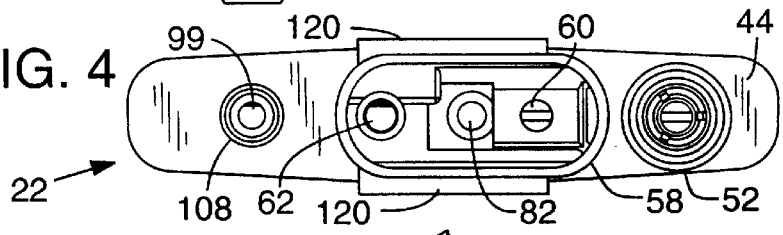
FIG. 4 is a bottom view of the chassis of FIG. 3.

In the illustrated embodiment, the valve 64 is a flapper valve positioned at the bottom of the pump inlet. The flapper valve 64 illustrated in FIGS. 1 and 2, is a rectangular piece of flexible material. The valve 64 is positioned over the bottom of the pump inlet 60 and heat staked to the chassis 22 at the midpoints of its short sides (the heat staked areas are darkened in the Figures). When the pressure within the chamber drops sufficiently below that in the reservoir, the unstaked sides of the valve each flex downward to allow the flow of ink around the valve 64, through the pump inlet 60 and into the chamber 56. In alternative embodiments, the flapper valve could be heat staked on only one side so that the entire valve would flex about the staked side, or on three sides so that only one side of the valve would flex. Other types of valves may also be suitable.

In the illustrated embodiment the flapper valve 64 is made of a two ply material. The top ply is a layer of low density polyethylene 0.0015 inches thick. The bottom ply is a layer of polyethylene terephthalate (PET) 0.0005 inches thick. A layer of adhesive connects the two together. The illustrated flapper valve 64 is approximately 5.5 millimeters wide and 8.7 millimeters long. Of course, in other embodiments, other materials or other types or sizes of valves may be used.

A flexible diaphragm 66 encloses the bottom of the chamber 56. The diaphragm 66 is slightly larger than the opening at the bottom of the chamber 56 and is sealed around the bottom edge of the wall 58. The excess material in the oversized diaphragm allows the diaphragm to flex up and down to vary the volume within the chamber. In the illustrated ink supply, displacement of the diaphragm allows the volume of the chamber 56 to be varied by about 0.7 cubic centimeters. The fully expanded volume of the illustrated chamber 56 is between about 2.2 and 2.5 cubic centimeters.

In the illustrated embodiment, the diaphragm 66 is made of the same multi-ply material as the plastic sheets 50. Of course, other suitable materials may also be used to form the diaphragm. The diaphragm in the illustrated embodiment is heat staked, using conventional methods, to the bottom edge of the skirt-like wall 58. During the heat staking process, the low density polyethylene in the diaphragm seals any folds or wrinkles in the diaphragm to create a leak proof connection.

Figure 5:
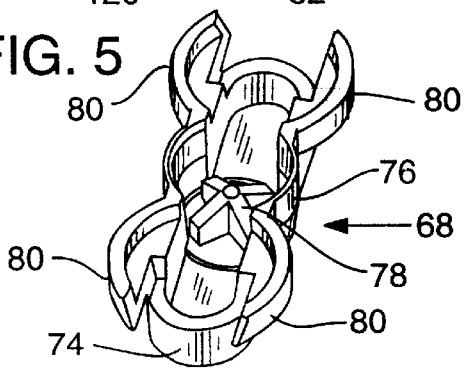
FIG. 5 is a top perspective view of the pressure plate of the ink supply of FIG. 1.
Figure 6:
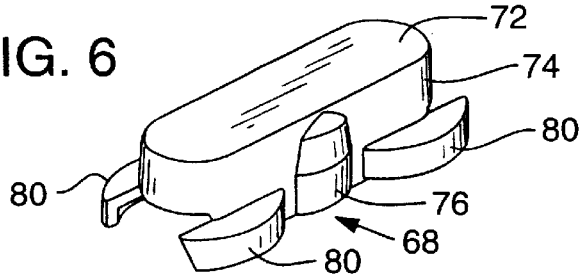
FIG. 6 is a bottom perspective view of the pressure plate of FIG. 5.

A pressure plate 68 and a spring 70 are positioned within the chamber 56. The pressure plate 68, illustrated in detail in FIGS. 5 and 6, has a smooth lower face 72 with a wall 74 extending upward about its perimeter. The central region 76 of the pressure plate 68 is shaped to receive the lower end of the spring 70 and is provided with a spring retaining spike 78. Four wings 80 extend laterally from an upper portion of the wall 74. The illustrated pressure plate is molded of high density polyethylene.

The pressure plate 68 is positioned within the chamber 56 with the lower face 72 adjacent the flexible diaphragm 66. The upper end of the spring 70, which is stainless steel in the illustrated embodiment, is retained on a spike 82 formed in the chassis and the lower end of the spring 70 is retained on the spike 78 on the pressure plate 68. In this manner, the spring biases the pressure plate downward against the diaphragm to increase the volume of the chamber. The wall 74 and wings 80 serve to stabilize the orientation of the pressure plate while allowing for its free, piston-like movement within the chamber 56. The structure of the pressure plate, with the wings extending outward from the smaller face, provides clearance for the heat stake joint between the diaphragm and the wall and allows the diaphragm to flex without being pinched as the pressure plate moves up and down. The wings are also spaced to facilitate fluid flow within the pump.

As illustrated in FIG. 2, a conduit 84 joins the pump outlet 62 to the fluid outlet 28. In the illustrated embodiment, the top wall of the conduit 84 is formed by the lower member of the frame 46, the bottom wall is formed by the body 44 of the chassis, one side wall is formed by the chassis and the other side is enclosed by a portion of one of the plastic sheets 50.

As illustrated in FIGS. 1 and 2, the fluid outlet 28 is housed within a hollow cylindrical boss 99 that extends downward from the chassis 22. The top of the boss 99 opens into the conduit 84 to allow ink to flow from the conduit into the fluid outlet. A spring 100 and sealing ball 102 are positioned within the boss 99 and are held in place by a compliant septum 104 and a crimp cover 106. The length of the spring 100 is such that it can be placed into the inverted boss 99 with the ball 102 on top. The septum 104 can then inserted be into the boss 99 to compress the spring 100 slightly so that the spring biases the sealing ball 102 against the septum 104 to form a seal. The crimp cover 106 fits over the septum 104 and engages an annular projection 108 on the boss 99 to hold the entire assembly in place.

In the illustrated embodiment, both the spring 100 and the ball 102 are stainless steel. The sealing ball 102 is sized such that it can move freely within the boss 99 and allow the flow of ink around the ball when it is not in the sealing position. The septum 104 is formed of polyisoprene rubber and has a concave bottom to receive a portion of the ball 102 to form a secure seal. The septum 104 is provided with a slit 110 so that it may be easily pierced without tearing or coring. However, the slit is normally closed such that the septum itself forms a second seal. The slit may, preferably, be slightly tapered with its narrower end adjacent the ball 102. The illustrated crimp cover 106 is formed of aluminum and has a thickness of about 0.020 inches. A hole 112 is provided so that the crimp cover 106 does not interfere with the piercing of the septum 104.

With the pump and fluid outlet in place, the ink reservoir 24 can be filled with ink. To fill the ink reservoir 24, ink can be injected through the fill port 52. As ink is being introduced into the reservoir, a needle (not shown) can be inserted through the slit 110 in the septum 104 to depress the sealing ball 102 and allow the escape of any air from within the reservoir. Alternatively, a partial vacuum can be applied through the needle. The partial vacuum at the fluid outlet causes ink from the reservoir 24 to fill the chamber 56, the conduit 84, and the cylindrical boss 99 such that little, if any, air remains in contact with the ink. The partial vacuum applied to the fluid outlet also speeds the filling process. Once the ink supply is filled, the plug 54 is press fit into the fill port to prevent the escape of ink or the entry of air.

Of course, there are a variety of other methods which might also be used to fill the present ink supply. For example, ink may could be introduced into the reservoir through the refill port. In some instances, it may be desirable to flush the entire ink supply with carbon dioxide prior to filling it with ink. In this way, any gas trapped within the ink supply during the filling process will be carbon dioxide, not air. This may be preferable because carbon dioxide may dissolve in some inks while air may not. In general, it is preferable to remove as much gas from the ink supply as possible so that bubbles and the like do not enter the print head or the trailing tube. To this end, it may also be preferable to use degassed ink to further avoid the creation or presence of bubbles in the ink supply.

Although the ink reservoir 24 provides an ideal way to contain ink, it may be easily punctured or ruptured and may allow some amount of water loss from the ink. Accordingly, to protect the reservoir 24 and to further limit water loss, the reservoir 24 is enclosed within a protective shell 30. In the illustrated embodiment, the shell 30 is made of clarified polypropylene. A thickness of about one millimeter has been found to provide robust protection and to prevent unacceptable water loss from the ink. However, the material and thickness of the shell may vary in other embodiments.

As illustrated in FIG. 1, the top of the shell 30 has contoured gripping surfaces 114 that are shaped and textured to allow a user to easily grip and manipulate the ink supply 20. An aperture 115 allows access to the refill port 51. The cap 53 for the refill port extends through the aperture 115 to allow a user to grip the cap and remove it to open the refill port. A vertical rib 116 having a detente 118 formed near its lower end projects laterally from each side of the shell 30. The base of the shell 30 is open to allow insertion of the chassis 22. A stop 120 extends laterally outward from each side of the wall 58 that defines the chamber 56. These stops 120 abut the lower edge of the shell 30 when the chassis 22 is inserted.

A protective cap 32 is fitted to the bottom of the shell 30 to maintain the chassis 22 in position. The cap 32 is provided with recesses 128 which receive the stops 120 on the chassis 22. In this manner, the stops are firmly secured between the cap and the shell to maintain the chassis in position. The cap is also provided with an aperture 34 to allow access to the pump 26 and with an aperture 36 to allow access to the fluid outlet 28. The cap 32 obscures the fill port to help prevent tampering with the ink supply.

The cap is provided with projecting keys 130 which can identify the type of printer for which the ink supply is intended and the type of ink contained within the ink supply. For example, if the ink supply is filled with black ink, a cap having keys that indicate black ink may be used. Similarly, if the ink supply is filled with a particular color of ink, a cap indicative of that color may be used. The color of the cap may also be used to indicate the color of ink contained within the ink supply.

As a result of this structure, the chassis and shell can be manufactured and assembled without regard to the particular type of ink they will contain. Then, after the ink reservoir is filled, a cap indicative of the particular ink used is attached to the shell. This allows for manufacturing economies because a supply of empty chassis and shells can be stored in inventory. Then, when there is a demand for a particular type of ink, that ink can be introduced into the ink supply and an appropriate cap fixed to the ink supply. Thus, this scheme reduces the need to maintain high inventories of ink supplies containing every type of ink.

In the illustrated embodiment, the bottom of the shell 30 is provided with two circumferential grooves 122 which engage two circumferential ribs 124 formed on the cap 32 to secure the cap to the shell. Sonic welding or some other mechanism may also be desirable to more securely fix the cap to the shell. In addition, a label (not shown) can be adhered to both the cap and the shell to more firmly secure them together. In the illustrated embodiment, pressure sensitive adhesive is used to adhere the label in a manner that prevents the label from being peeled off and inhibits tampering with the ink supply.

The attachment between the shell, the chassis and the cap should, preferably, be snug enough to prevent accidental separation of the cap from the shell and to resist the flow of ink from the shell should the ink reservoir develop a leak. However, it is also desirable that the attachment allow the slow ingress of air into the shell as ink is depleted from the reservoir to maintain the pressure inside the shell generally the same as the ambient pressure. Otherwise, a negative pressure may develop inside the shell and inhibit the flow of ink from the reservoir. The ingress of air should be limited, however, in order to maintain a high humidity within the shell and minimize water loss from the ink.

In the illustrated embodiment, the shell 30 and the flexible reservoir 24 which it contains have the capacity to hold approximately thirty cubic centimeters of ink. The shell is approximately 67 millimeters wide, 15 millimeters thick, and 60 millimeters high. Of course, other dimensions and shapes can also be used depending on the particular needs of a given printer.

Figure 7:
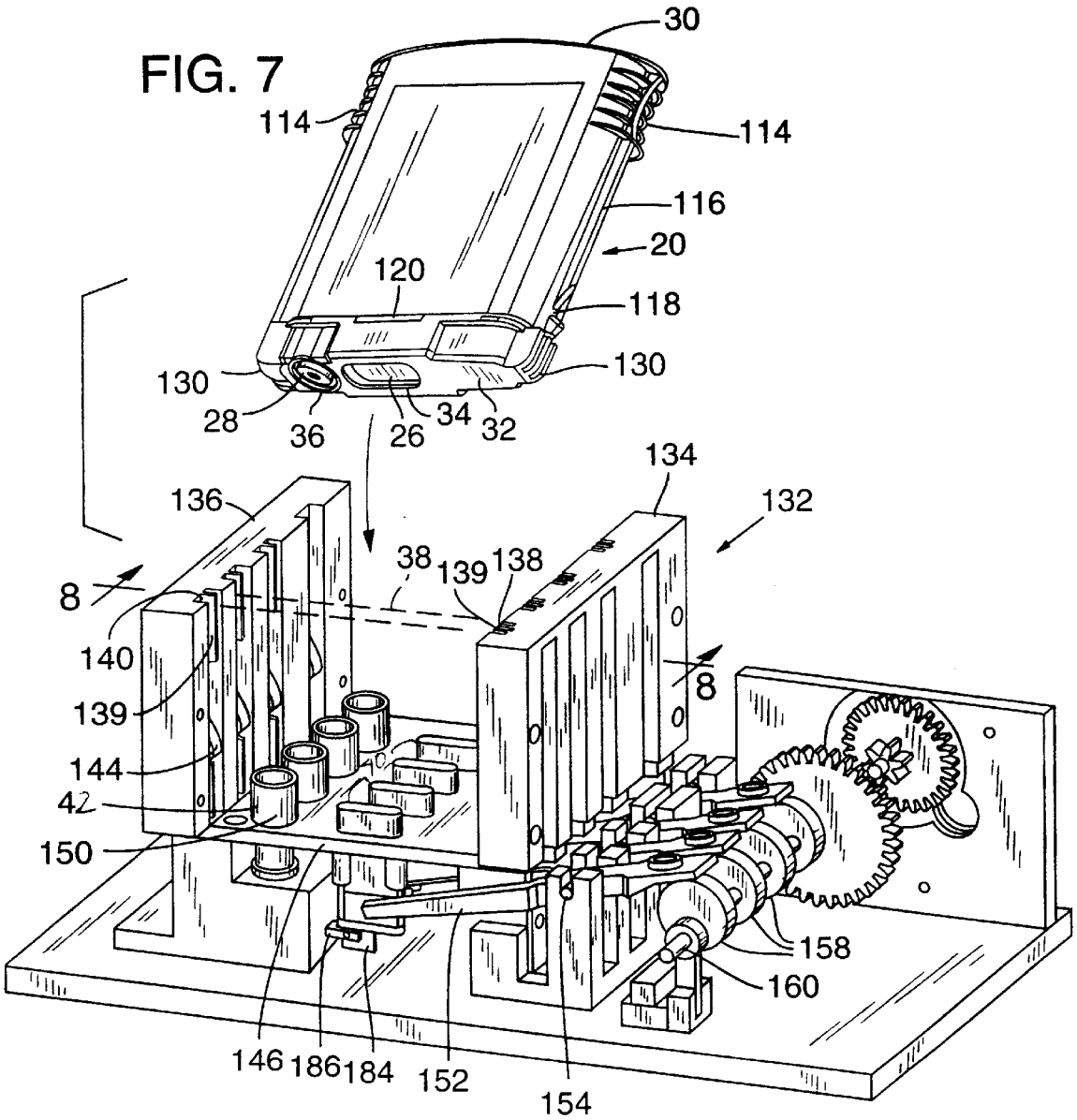
FIG. 7 shows the ink supply if FIG. 1 being inserted into a docking bay of an ink-jet printer.

The illustrated ink supply 20 is ideally suited for insertion into a docking station 132 like that illustrated in FIGS. 7–10. The docking station 132 illustrated in FIG. 7, is intended for use with a color printer. Accordingly, it has four side-by-side docking bays 38, each of which can receive one ink supply 20 of a different color. The structure of the illustrated ink supply allows for a relatively narrow width. This allows for four ink supplies to be arranged side-by-side in a compact docking station without unduly increasing the "footprint" of the printer.

Each docking bay 38 includes opposing walls 134 and 136 which define inwardly facing vertical channels 138 and 140. A leaf spring 142 having an engagement prong 144 is positioned within the lower portion of each channel 138 and 140. The engagement prong 144 of each leaf spring 142 extends into the channel toward the docking bay 38 and is biased inward by the leaf spring. The channels 138 and 140 are provided with mating keys 139 formed therein. In the illustrated embodiment, the mating keys in the channels on one wall are the same for each docking bay and identify the type of printer in which the docking station is used. The mating keys in the channels of the other wall are different for each docking bay and identify the color of ink for use in that docking bay. A base plate 146 defines the bottom of each docking bay 38. The base plate 146 includes an aperture 148 which receives the actuator 40 and carries a housing 150 for the fluid inlet 42.

As illustrated in FIG. 7, the upper end of the actuator extends upward through the aperture 148 in the base plate 146 and into the docking bay 38. The lower portion of the actuator 40 is positioned below the base plate and is pivotably coupled to one end of a lever 152 which is supported on pivot point 154. The other end of the lever 154 is biased downward by a compression spring 156. In this manner, the force of the compression spring 156 urges the actuator 40 upward. A cam 158 mounted on a rotatable shaft 160 is positioned such that rotation of the shaft to an engaged position causes the cam to overcome the force of the compression spring 156 and move the actuator 40 downward. Movement of the actuator, as explained in more detail below, causes the pump 26 to draw ink from the reservoir 24 and supply it through the fluid outlet 28 and the fluid inlet 42 to the printer.

Figure 10:
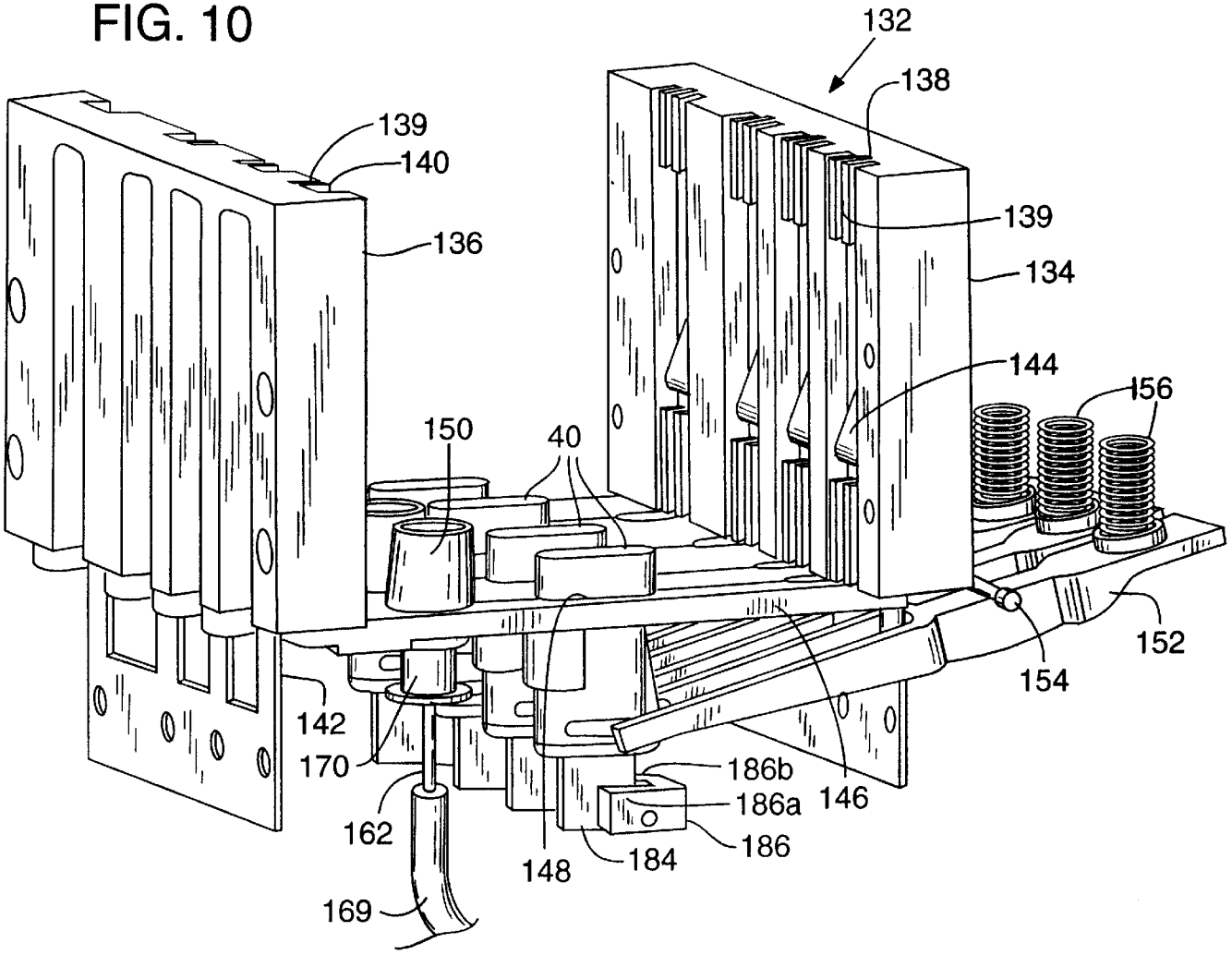
FIG. 10 shows the docking bay of FIG. 7 with a portion of the docking bay cutaway to reveal an out-of-ink detector.

As illustrated in FIG. 10, a flag 184 extends downward from the bottom of the actuator 40 where it is received within an optical detector 186. The optical detector 186 is of conventional construction and directs a beam of light from one leg 186*a* toward a sensor (not shown) positioned on the other 186*b* leg. The optical detector is positioned such that when the actuator 40 is in its uppermost position, corresponding to the top of the pump stroke, the flag 184 raises above the beam of light allowing it to reach the sensor and activate the detector. In any lower position, the flag blocks the beam of light and prevents it from reaching the sensor and the detector is in a deactivated state. In this manner, the sensor can be used, as explained more fully below, to control the operation of the pump and to detect when an ink supply is empty.

Figure 8:
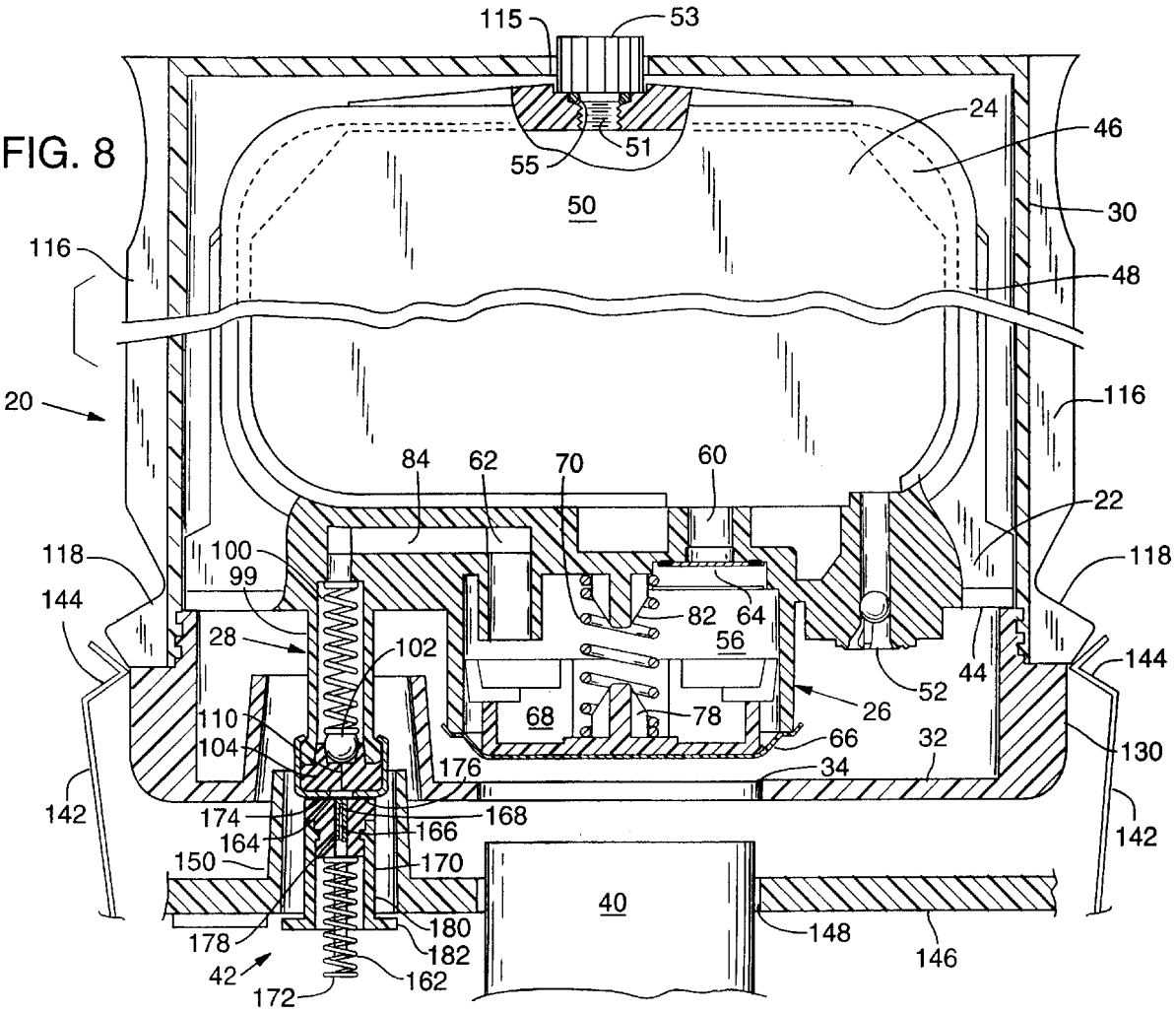
FIG. 8 is a cross sectional view of a part of the ink supply of FIG. 1 being inserted into the docking bay of an ink-jet printer, taken along line 8—8 of FIG. 7.

As seen in FIG. 8, the fluid inlet 42 is positioned within the housing 150 carried on the base plate 146. The illustrated fluid inlet 42 includes an upwardly extending needle 162 having a closed, blunt upper end 164, a blind bore 166 and a lateral hole 168. A trailing tube 169, seen in FIG. 10, is connected to the lower end of the needle 162 in fluid communication with the blind bore 166. The trailing tube 169 leads to a print head (not shown). In most printers, the print head will usually include a small ink well for maintaining a small quantity of ink and some type of pressure regulator to maintain an appropriate pressure within the ink well. Typically, it is desired that the pressure within the ink well be slightly less than ambient. This "back pressure" helps to prevent ink from dripping from the print head. The pressure regulator at the print head may commonly include a check valve which prevents the return flow of ink from the print head and into the trailing tube.

A sliding collar 170 surrounds the needle 162 and is biased upwardly by a spring 172. The sliding collar 170 has a compliant sealing portion 174 with an exposed upper surface 176 and an inner surface 178 in direct contact with the needle 162. In addition, the illustrated sliding collar includes a substantially rigid portion 180 extending downwardly to partially house the spring 172. An annular stop 182 extends outward from the lower edge of the substantially rigid portion 180. The annular stop 182 is positioned beneath the base plate 146 such that it abuts the base plate to limit upward travel of the sliding collar 170 and define an upper position of the sliding collar on the needle 162. In the upper position, the lateral hole 168 is surrounded by the sealing portion 174 of the collar to seal the lateral hole and the blunt end 164 of the needle is generally even with the upper surface 176 of the collar.

In the illustrated embodiment, the needle 162 is an eighteen gauge stainless steel needle with an inside diameter of about 1.04 millimeters, an outside diameter of about 1.2 millimeters, and a length of about 30 millimeters. The lateral hole is generally rectangular with dimensions of about 0.55 millimeters by 0.70 millimeters and is located about 1.2 millimeters from the upper end of the needle. The sealing portion 174 of the sliding collar is made of ethylene propylene dimer monomer and the generally rigid portion 176 is made of polypropylene or any other suitably rigid material. The sealing portion is molded with an aperture to snugly receive the needle and form a robust seal between the inner surface 178 and the needle 162. In other embodiments, alternative dimensions, materials or configurations might also be used.

To install an ink supply 20 within the docking bay 38, a user can simply place the lower end of the ink supply between the opposing walls 134 and 136 with one edge in one vertical channel 138 and the other edge in the other vertical channel 140, as shown in FIG. 7. The ink supply is then pushed downward into the installed position, shown in FIG. 9, in which the bottom of the cap 32 abuts the base plate 146. As the ink supply is pushed downward, the fluid outlet 28 and fluid inlet 42 automatically engage and open to form a path for fluid flow from the ink supply to the printer, as explained in more detail below. In addition, the actuator enters the aperture 34 in the cap 32 to pressurize the pump, as explained in more detail below.

Once in position, the engagement prongs 144 on each side of the docking station engage the detentes 118 formed in the shell 30 to firmly hold the ink supply in place. The leaf springs 142, which allow the engagement prongs to move outward during insertion of the ink supply, bias the engagement prongs inward to positively hold the ink supply in the installed position. Throughout the installation process and in the installed position, the edges of the ink supply 20 are captured within the vertical channels 138 and 140 which provide lateral support and stability to the ink supply. In some embodiments, it may be desirable to form grooves in one or both of the channels 138 and 140 which receive the vertical rib 116 formed in the shell to provide additional stability to the ink supply.

To remove the ink supply 20, a user simply grasps the ink supply, using the contoured gripping surfaces 114, and pulls upward to overcome the force of the leaf springs 142. Upon removal, the fluid outlet 28 and fluid inlet 42 automatically disconnect and reseal leaving little, if any, residual ink and the pump 26 is depressurized to reduce the possibility of any leakage from the ink supply.

Figure 9:
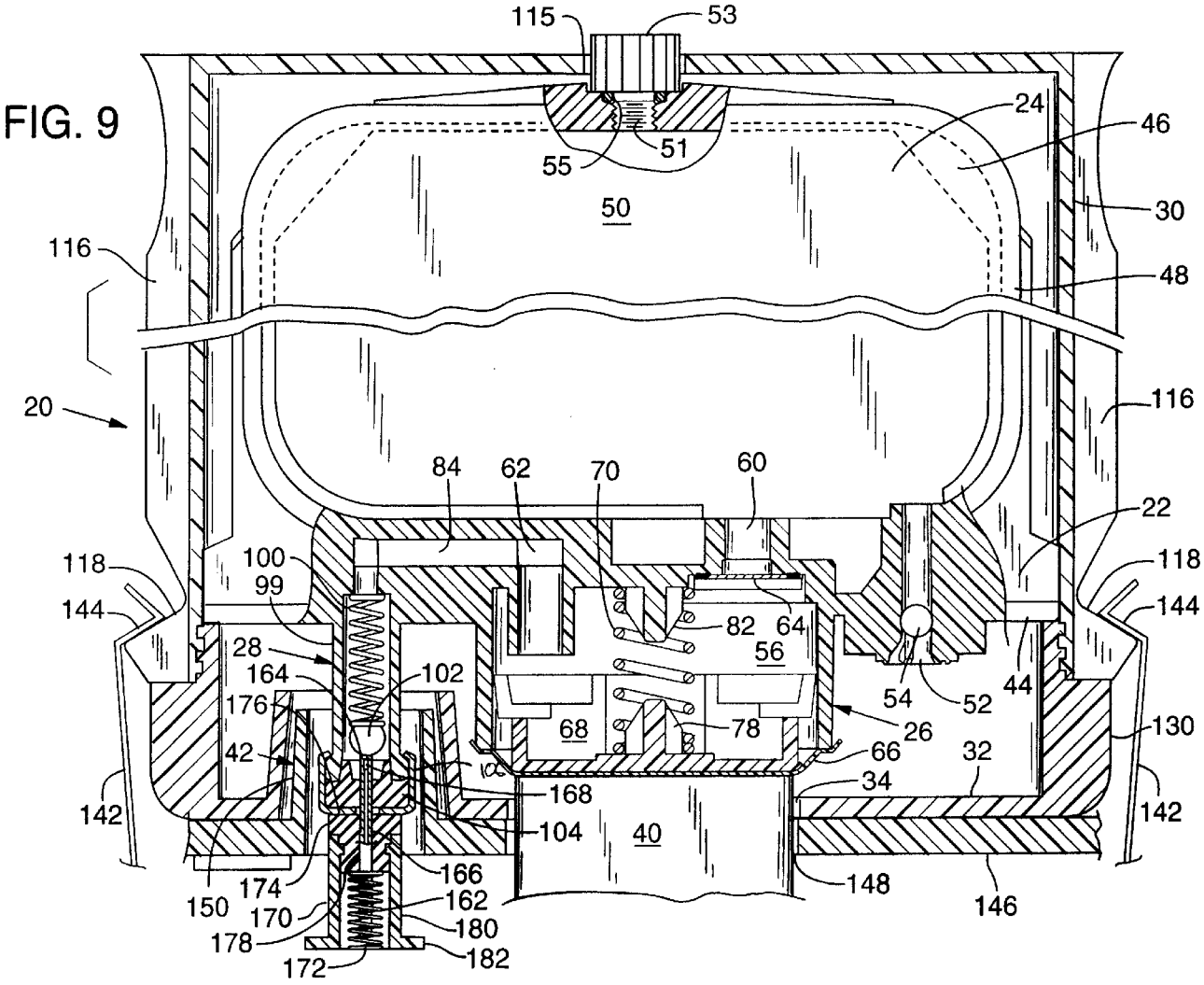
FIG. 9 is a cross sectional view showing the ink supply of FIG. 8 fully inserted into the docking bay.

Operation of the fluid interconnect, that is the fluid outlet 28 and the fluid inlet 42, during insertion of the ink supply is illustrated in FIGS. 8 and 9. FIG. 8 shows the fluid outlet 28 upon its initial contact with the fluid inlet 42. As illustrated in FIG. 8, the housing 150 has partially entered the cap 32 through aperture 36 and the lower end of the fluid outlet 28 has entered into the top of the housing 150. At this point, the crimp cover 106 contacts the sealing collar 170 to form a seal between the fluid outlet 28 and the fluid inlet 42 while both are still in their sealed positions. This seal acts as a safety barrier in the event that any ink should leak through the septum 104 or from the needle 162 during the coupling and decoupling process.

In the illustrated configuration, the bottom of the fluid inlet and the top of the fluid outlet are similar in shape. Thus, very little air is trapped within the seal between the fluid outlet of the ink supply and the fluid inlet of the printer. This facilitates proper operation of the printer by reducing the possibility that air will enter the fluid outlet 28 or the fluid inlet 42 and reach the ink jets in the print head.

As the ink supply 20 is inserted further into the docking bay 38, the bottom of the fluid outlet 28 pushes the sliding collar 170 downward, as illustrated in FIG. 9. Simultaneously, the needle 162 enters the slit 110 and passes through the septum 104 to depress the sealing ball 102. Thus, in the fully inserted position, ink can flow from the boss 99, around the sealing ball 102, into the lateral hole 168, down the bore 166, through the trailing tube 169 to the print head.

Upon removal of the ink supply 20, the needle 162 is withdrawn and the spring 100 presses the sealing ball 102 firmly against the septum to establish a robust seal. In addition, the slit 110 closes to establish a second seal, both of which serve to prevent ink from leaking through the fluid outlet 28. At the same time, the spring 172 pushes the sliding collar 170 back to its upper position in which the lateral hole 168 is encased within the sealing portion of the collar 174 to prevent the escape of ink from the fluid inlet 42. Finally, the seal between the crimp cover 106 and the upper surface 176 of the sliding collar is broken. With this fluid interconnect, little, if any, ink is exposed when the fluid outlet 28 is separated from the fluid inlet 42. This helps to keep both the user and the printer clean.

Although the illustrated fluid outlet 28 and fluid inlet 42 provide a secure seal with little entrapped air upon sealing and little excess ink upon unsealing, other fluid interconnections might also be used to connect the ink supply to the printer.

Figure 11A:
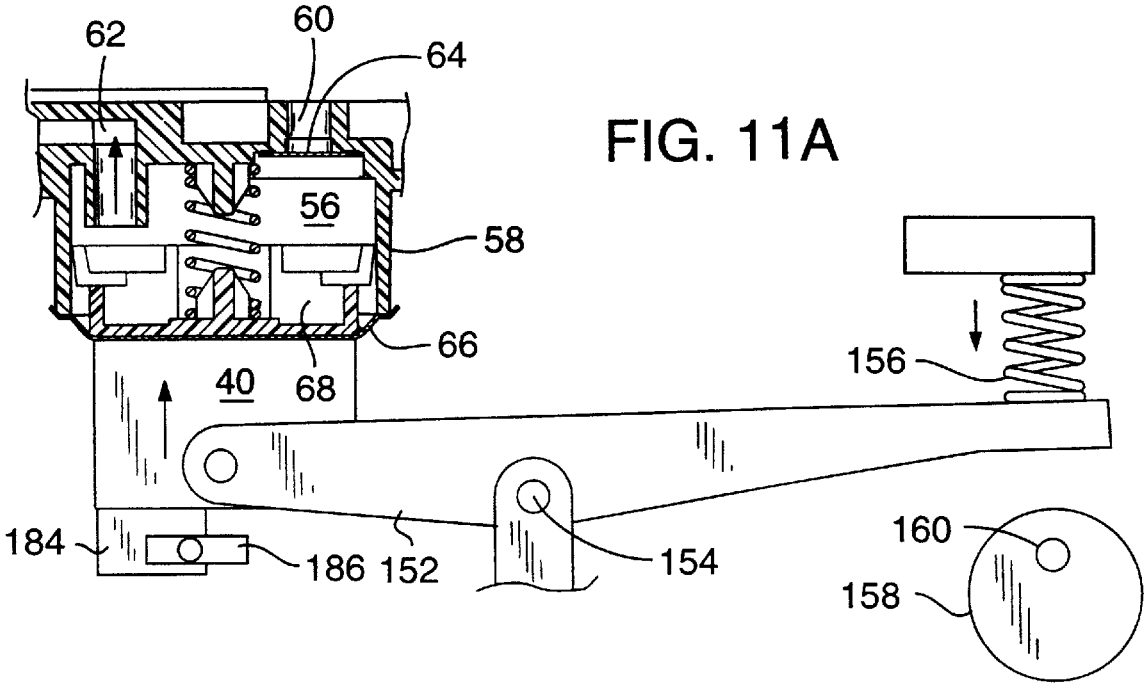
FIGS. 11A–11E are cross sectional views of a portion of the ink supply and docking bay showing the pump, actuator and out-of-ink detector in various stages of operation, taken along line 11—11 of FIG. 10.

As illustrated in FIG. 9, when the ink supply 20 is inserted into the docking bay 38, the actuator 40 enters through the aperture 34 in the cap 32 and into position to operate the pump 26. FIGS. 11A–E illustrate various stages of the pump's operation. FIG. 11A illustrates the fully charged position of the pump 26. The flexible diaphragm 66 is in its lowermost position, the volume of the chamber 56 is at its maximum, and the flag 184 is blocking the light beam from the sensor. The actuator 40 is pressed against the diaphragm 66 by the compression spring 156 to urge the chamber to a reduced volume and create pressure within the pump chamber 56. As the valve 64 limits the flow of ink from the chamber back into the reservoir, the ink passes from the chamber through the pump outlet 62 and the conduit 84 to the fluid outlet 28. In the illustrated embodiment, the compression spring is chosen so as to create a pressure of about 1.5 pounds per square inch within the chamber. Of course, the desired pressure may vary depending on the requirements of a particular printer and may vary throughout the pump stroke. For example, in the illustrated embodiment, the pressure within the chamber will vary from about 90–45 inches of water column during the pump stroke.

Figure 11B:
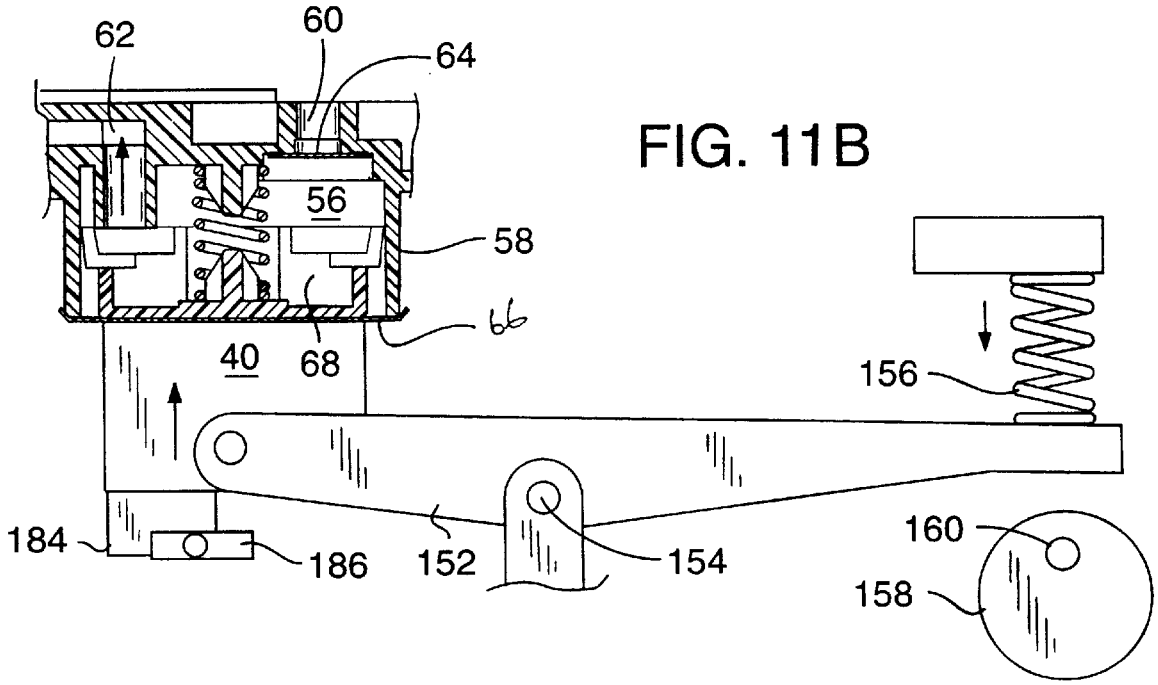

As ink is depleted from the pump chamber 56, the compression spring 156 continues to press the actuator 40 upward against the diaphragm 66 to maintain pressure within the pump chamber 56. This causes the diaphragm to move upward to an intermediate position decreasing the volume of the chamber, as illustrated in FIG. 11B. In the intermediate position, the flag 184 continues to block the beam of light from reaching the sensor in the optical detector 186.

Figure 11C:
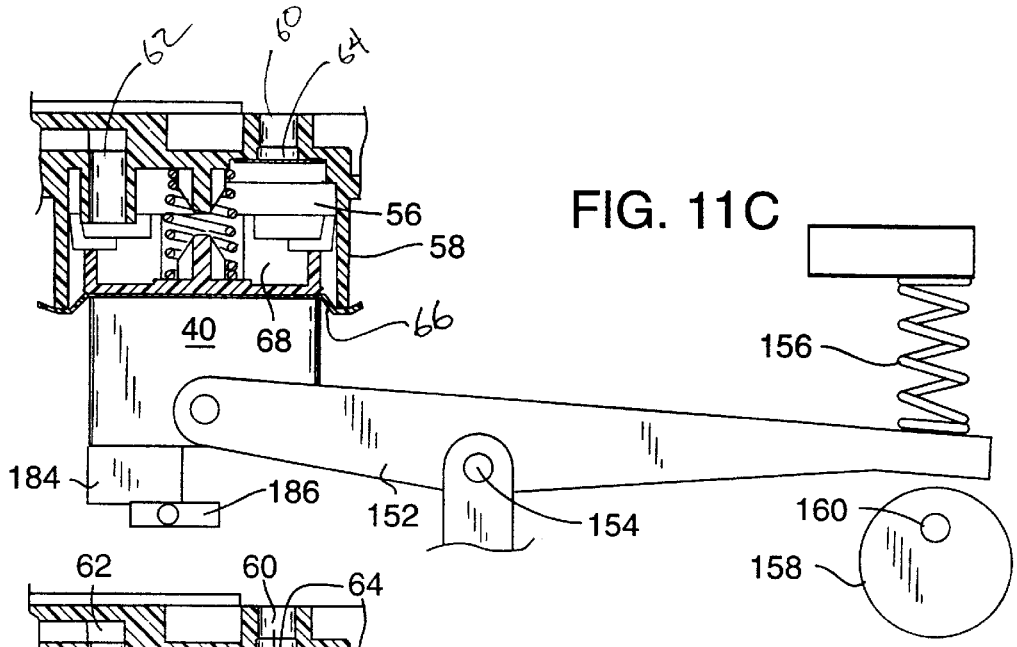

As still more ink is depleted from the pump chamber 56, the diaphragm 40 is pressed to its uppermost position, illustrated in FIG. 11C. In the uppermost position, the volume of the chamber 56 is at its minimum operational volume and the flag 184 rises high enough to allow the light beam to reach the sensor and activate the optical detector 186.

Figure 11D:
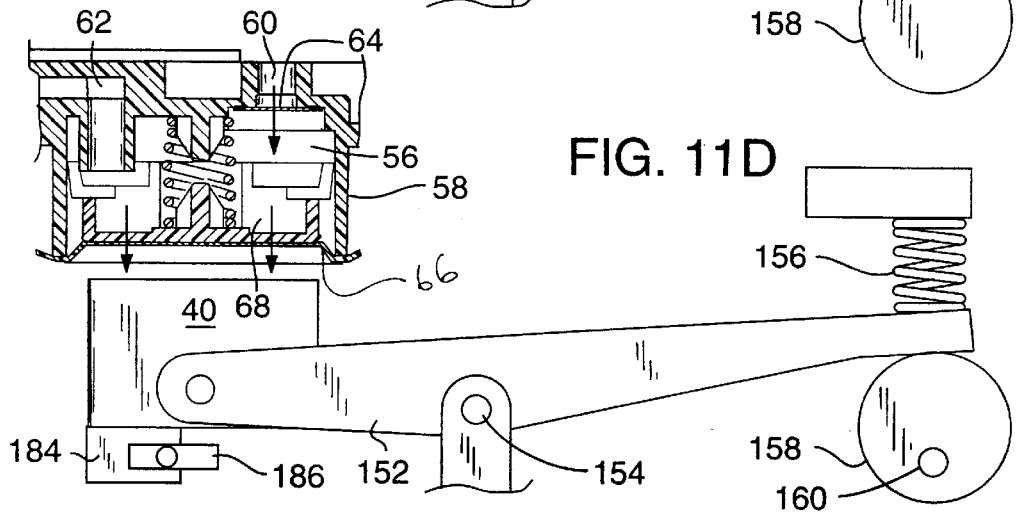

The printer control system (not shown) detects activation of the optical detector 186 and begins a refresh cycle. As illustrated in FIG. 11D, during the refresh cycle the cam 158 is rotated into engagement with the lever 152 to compress the compression spring 156 and move the actuator 40 to its lowermost position. In this position, the actuator 40 does not contact the diaphragm 66.

With the actuator 40 no longer pressing against the diaphragm 66, the pump spring 70 biases the pressure plate 68 and diaphragm 66 outward, expanding the volume and decreasing the pressure within the chamber 56. The decreased pressure within the chamber 56 allows the valve 64 to open and draws ink from the reservoir 24 into the chamber 56 to refresh the pump 26, as illustrated in FIG. 11D. The check valve at the print head, the flow resistance within the trailing tube, or both will limit ink from returning to the chamber 56 through the conduit 84. Alternatively, a check valve may be provided at the outlet port, or at some other location, to prevent the return of ink through the outlet port and into the chamber.

After a predetermined amount of time has elapsed, the refresh cycle is concluded by rotating the cam 158 back into its disengaged position and the ink supply typically returns to the configuration illustrated in FIG. 11A.

Figure 11E:
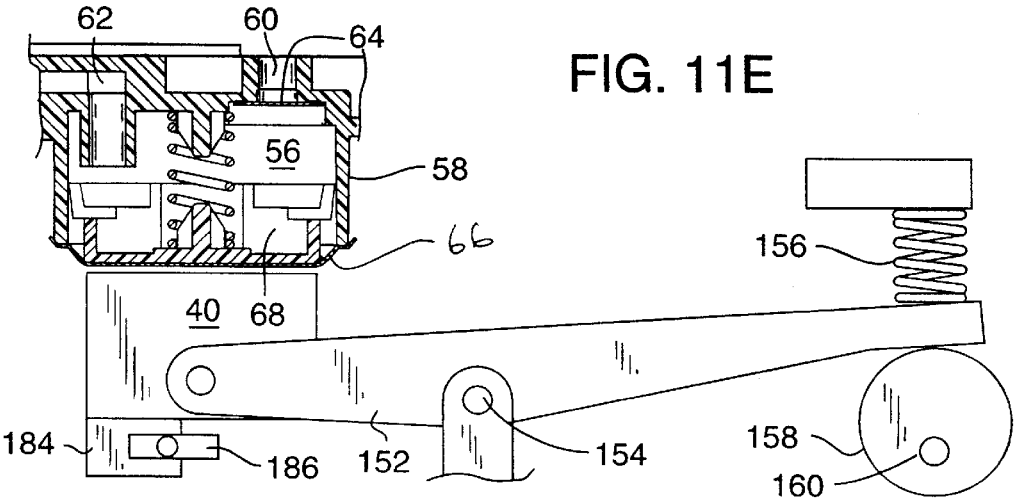

However, if the ink supply is out of ink, no ink can enter into the pump chamber 56 during a refresh cycle. In this case, the backpressure within the ink reservoir 24 will prevent the chamber 56 from expanding. As a result, when the cam 158 is rotated back into its disengaged position, the actuator 40 returns to its uppermost position, as illustrated in FIG. 11E, and the optical detector 186 is again activated. Activation of the optical detector immediately after a refresh cycle, informs the control system that the ink supply is out of ink (or possibly that some other malfunction is preventing the proper operation of the ink supply). In response, the control system can generate a signal informing the user that the ink supply requires replacement. This can greatly extend the life of the print head by preventing "dry" firing of the ink jets.

In some embodiments in may be desirable to rotate the cam 158 to the disengaged position and remove pressure from the chamber 56 whenever the printer is not printing. It should also be appreciated that a mechanical switch, an electrical switch, or some other switch capable of detecting the position of the actuator could be used in place of the optical detector.

The configuration of the present ink supply is particularly advantageous because only the relatively small amount of ink within the chamber is pressurized. The large majority of the ink is maintained within the reservoir at approximately ambient pressure. Thus, it is less likely to leak and, in the event of a leak, can be more easily contained.

The illustrated diaphragm pump has proven to be very reliable and well suited for use in the ink supply. However, other types of pumps may also be used. For example, a piston pump, a bellows pump, or other types of pumps might be adapted for use with the present invention.

As discussed above, the illustrated docking station 132 includes four side-by-side docking bays 38. This configuration allows the wall 134, the wall 136 and the base plate 146 for the four docking bays to be unitary. In the illustrated embodiment, the leaf springs for each side of the four docking bays can be formed as a single piece connected at the bottom. In addition, the cams 158 for each docking station are attached to a single shaft 160. Using a single shaft results in each of the four ink supplies being refreshed when the pump of any one of the four reaches its minimum operational volume. Alternatively, it may be desirable to configure the cams and shaft to provide a third position in which only the black ink supply is pressurized. This allows the colored ink supplies to remain at ambient pressure during a print job that requires only black ink.

The arrangement of four side-by-side docking bays is intended for use in a color printer. One of the docking bays is intended to receive an ink supply containing black ink, one an ink supply containing yellow ink, one an ink supply containing cyan ink, and one an ink supply containing magenta ink. The mating keys 139 for each of the four docking bays are different and correspond to the color of ink for that docking bay. The mating keys 139 are shaped to receive the corresponding keys 130 formed on a cap of an ink supply having the appropriate color. That is, the keys 130 and the mating keys 139 are shaped such that only an ink supply having the correct color of ink, as indicated by the keys on the cap, can be inserted into any particular docking bay. The mating keys 139 can also identify the type of ink supply that is to be installed in the docking bay. This system helps to prevent a user from inadvertently inserting an ink supply of one color into a docking bay for another color or from inserting an ink supply intended for one type of printer into the wrong type of printer.

Figure 12:
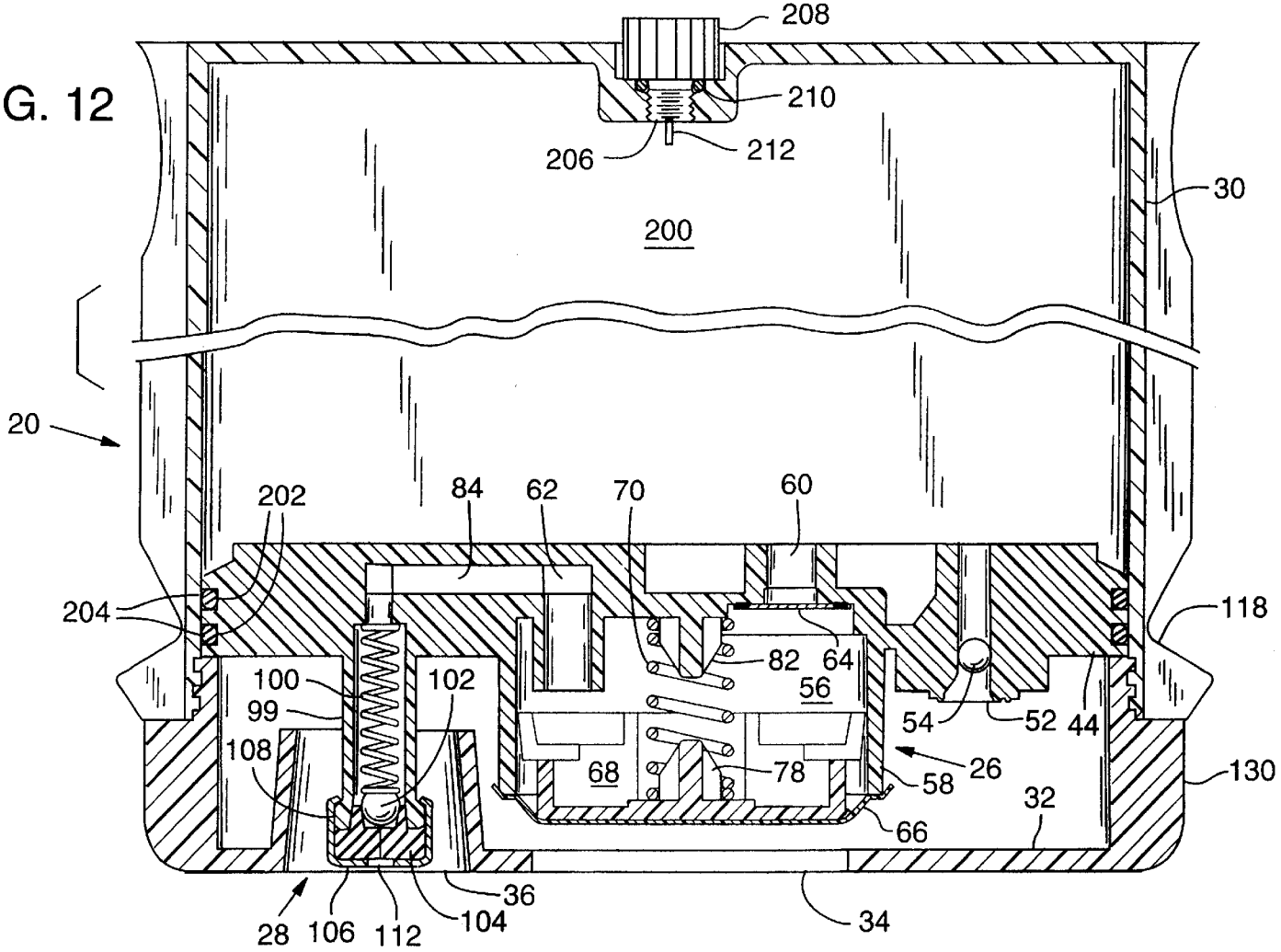
FIG. 12 is a cross sectional view of an alternative embodiment of an ink supply in accordance with the present invention.

FIG. 12 illustrates an alternative embodiment of an ink supply in accordance with the present invention. The pump 26 and fluid outlet 28 are generally the same as described above. The fill port 52 is optional. However, in the embodiment of FIG. 12, there is no frame or flexible reservoir. Rather, the body of the chassis 44 is received snugly by the shell 30 to define a rigid reservoir 200. In the illustrated embodiment, the body 44 is provided with two circumferential grooves 202, each of which receives an o-ring 204 to ensure a tight, leak-free seal between the body 44 and the shell 30. An aperture 206 is provided in the top surface of the shell 30 to allow access to the interior of the reservoir 200. In the illustrated embodiment, a cap 208 having a sealing o-ring 210 can be threaded into the aperture 206 to close the aperture. In this manner, the cap can be removed and ink added to the reservoir. A vent 212 is provided to allow the ingress of air into the reservoir 200 as ink is depleted.

Figure 13:
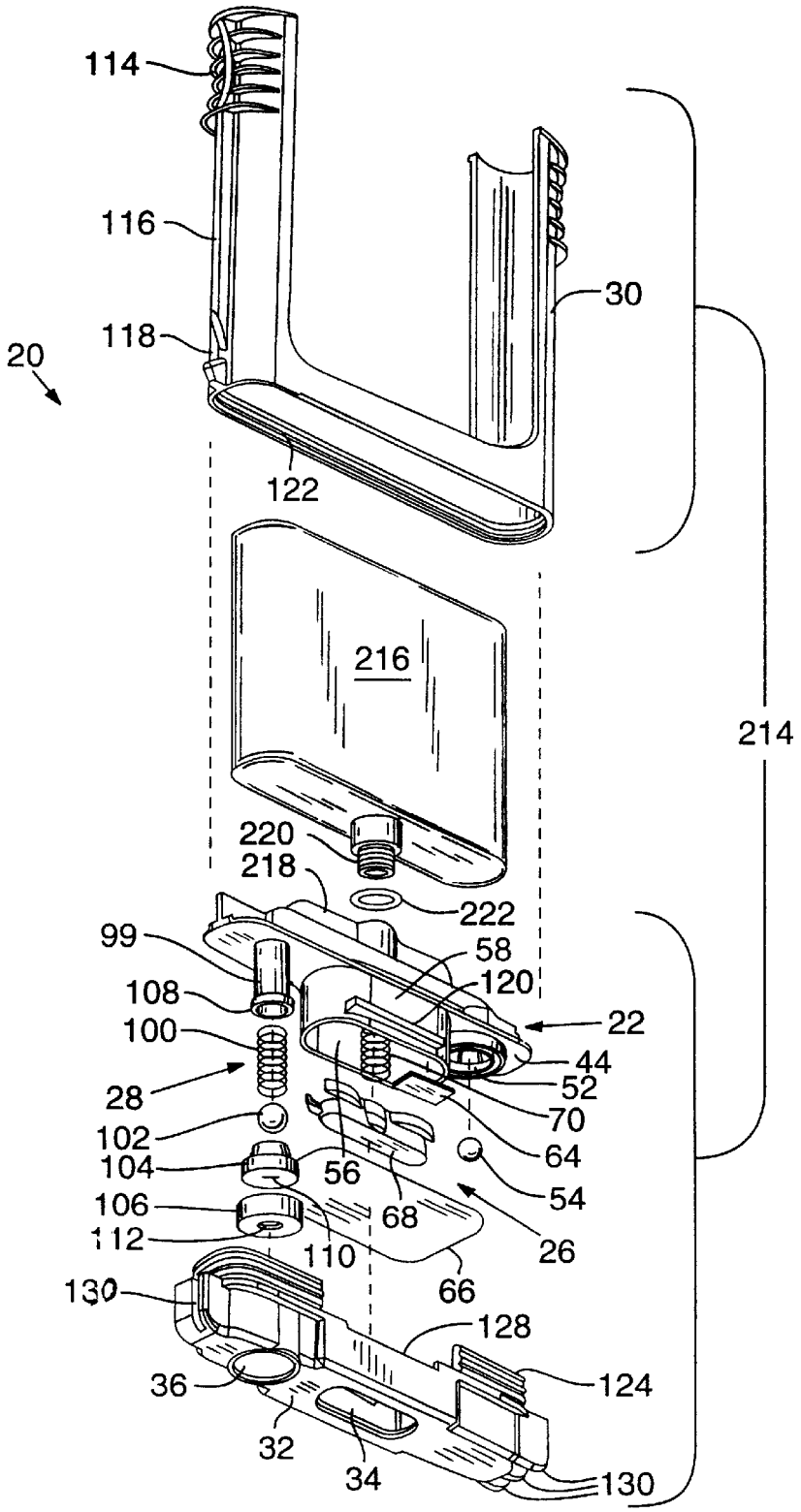
FIG. 13 is an exploded view of the ink supply of FIG. 12.
Figure 14:
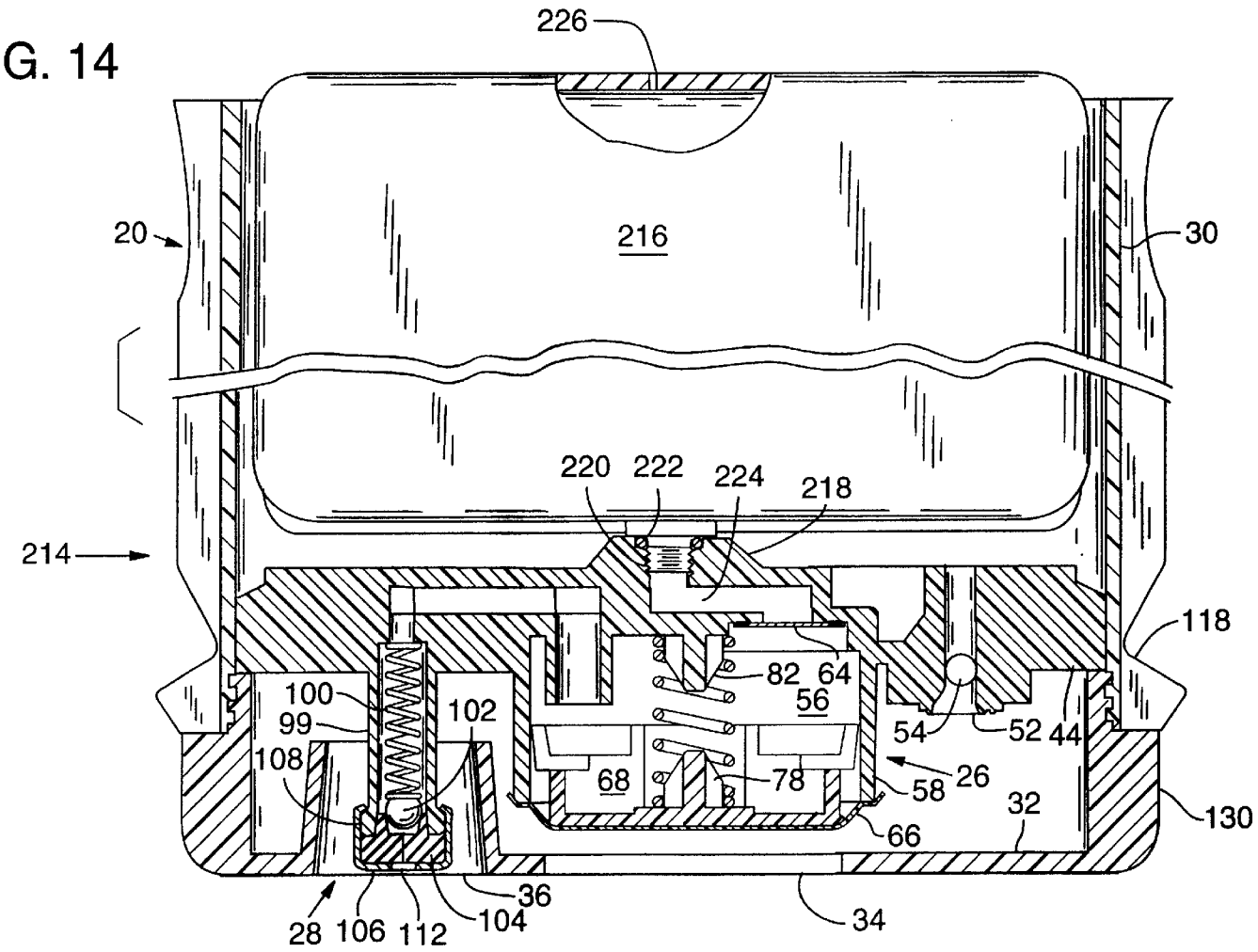
FIG. 14 is a cross sectional view of an alternative embodiment of an ink supply in accordance with the present invention.

In another embodiment of an ink supply in accordance with the present invention, illustrated in FIGS. 13 and 14, the ink supply includes an adapter portion 214 and removable reservoir 216. The adapter portion carries a pump 26, a fluid outlet 28, and the necessary elements to allow it to be received and mounted within a docking bay 38. In addition, the adapter includes a fitment 218 into which the removable reservoir 216 may be received. In the illustrated embodiment, the removable reservoir 216 has a narrow width to fit within the docking bay 38 and has a threaded neck 220 which can be threaded into corresponding threads formed in the fitment to secure the reservoir 216 to the adapter portion 214. Portions of the shell 30 are cut away to allow the reservoir 216 to rotate as it is threaded into the fitment. An o-ring 222 provides a robust seal to prevent ink from leaking from the fitment when the reservoir 216 is installed. With the reservoir in the installed position, ink can flow from the neck of the reservoir, through a passageway 224 to the pump 26. In the illustrated embodiment of FIGS. 13 and 14, the reservoir 216 is provided with a vent 226 to allow the ingress of air as ink is depleted from the reservoir. The vent is such that it does not allow ink to leak from the reservoir and may be covered with a hydrophobic material or include some other mechanism for retaining ink within the reservoir.

Figure 15:
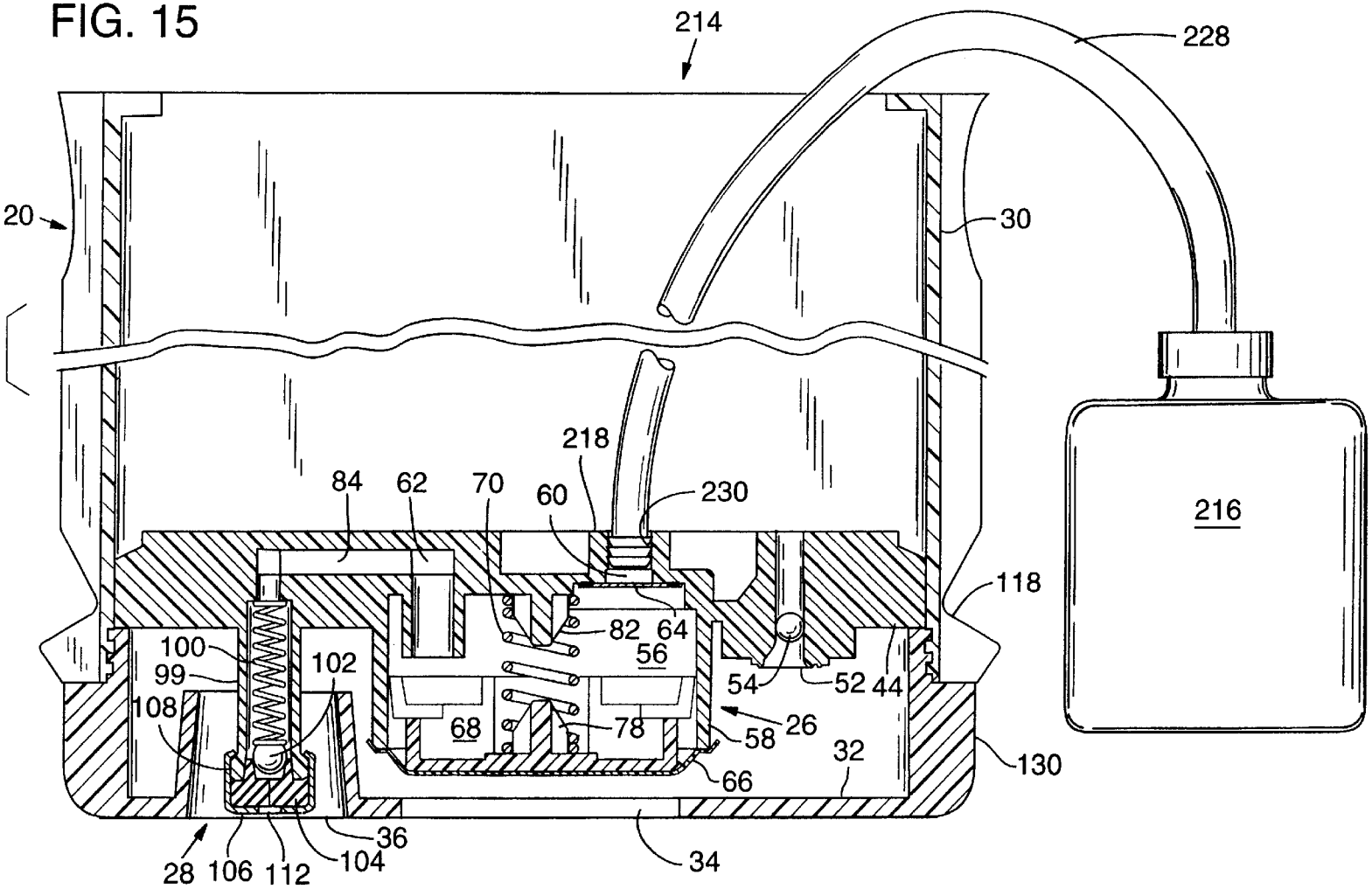
FIG. 15 is a cross sectional view of another alternative embodiment of an ink supply in accordance with the present invention.

In another embodiment of an ink supply in accordance with the present invention, illustrated in FIG. 15, the adapter portion is similar to the embodiment of FIGS. 13 and 14. However, the fitment 218 is designed to receive tube 228 which provides a fluid passageway from the removable ink reservoir 216. In the embodiment of FIG. 15, the fitment 218 is provided directly over the pump inlet 60. The end of the tube 228 is provided with barbs 230, annular engagement rings, threads or the like to engage the fitment.

Figure 16:
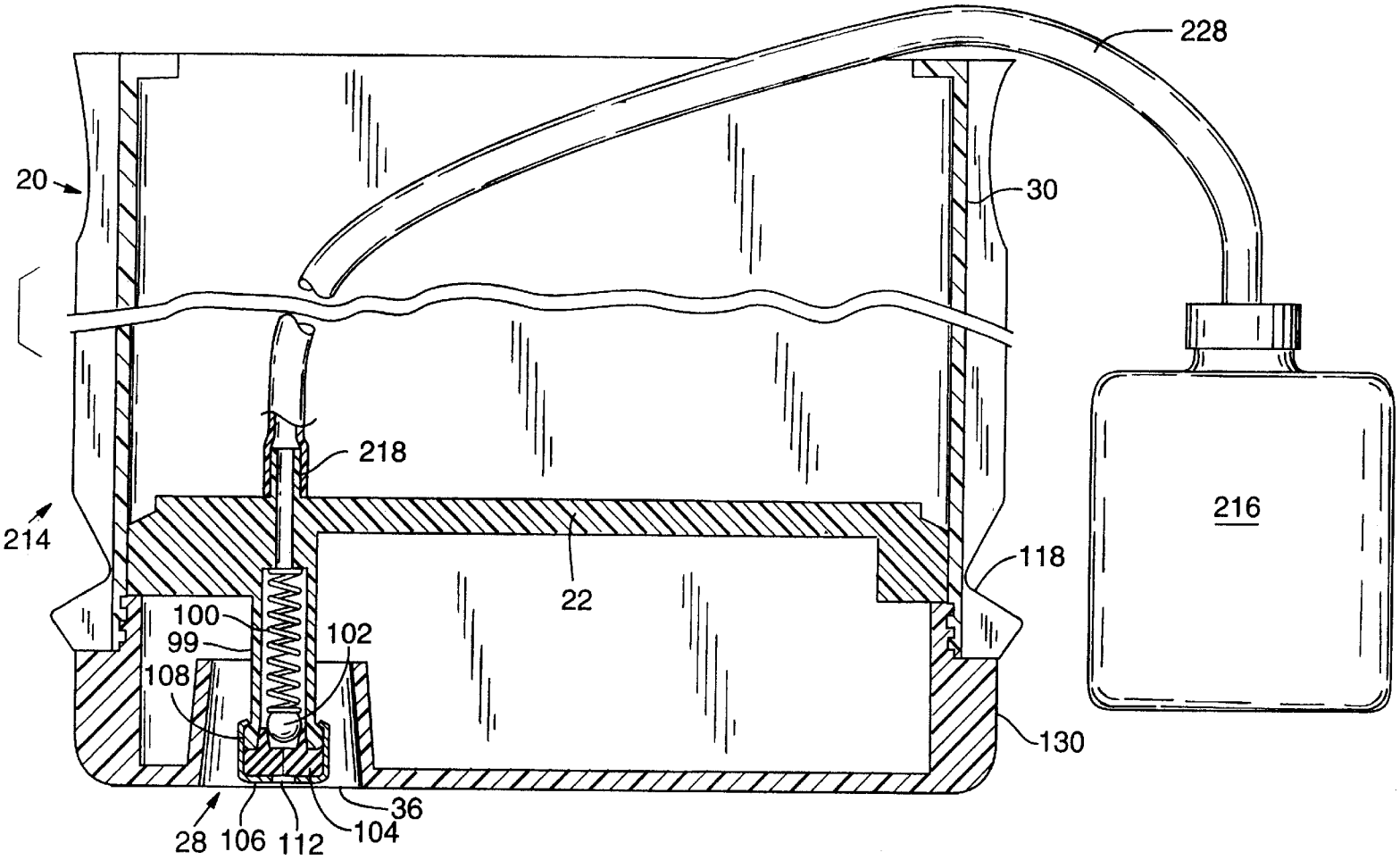
FIG. 16 is a cross sectional view of yet another alternative embodiment of an ink supply in accordance with the present invention.

If an alternative method of transferring ink to the print head is provided, the pump 26 may be unnecessary. For example, in the embodiment illustrated in FIG. 16, the tube 228 connects to a fitment 218 in direct communication with the fluid outlet 28 and the adapter does not include a pump. Rather, the reservoir 216 may be pressurized in some manner to transfer ink directly through the fluid outlet 28 to the print head. Alternatively, the reservoir may be positioned such that gravity flow is sufficient to transfer the ink from the reservoir 216 to the print head. The cap 32 does not have an aperture for the pump actuator 40. As a result, the pump actuator will engage the cap when it is move into the engaged position. This will prevent the actuator from moving to its uppermost position so that the printer will not receive an out-of-ink detect signal and will not attempt to refresh the pump as explained above.

Figure 17:
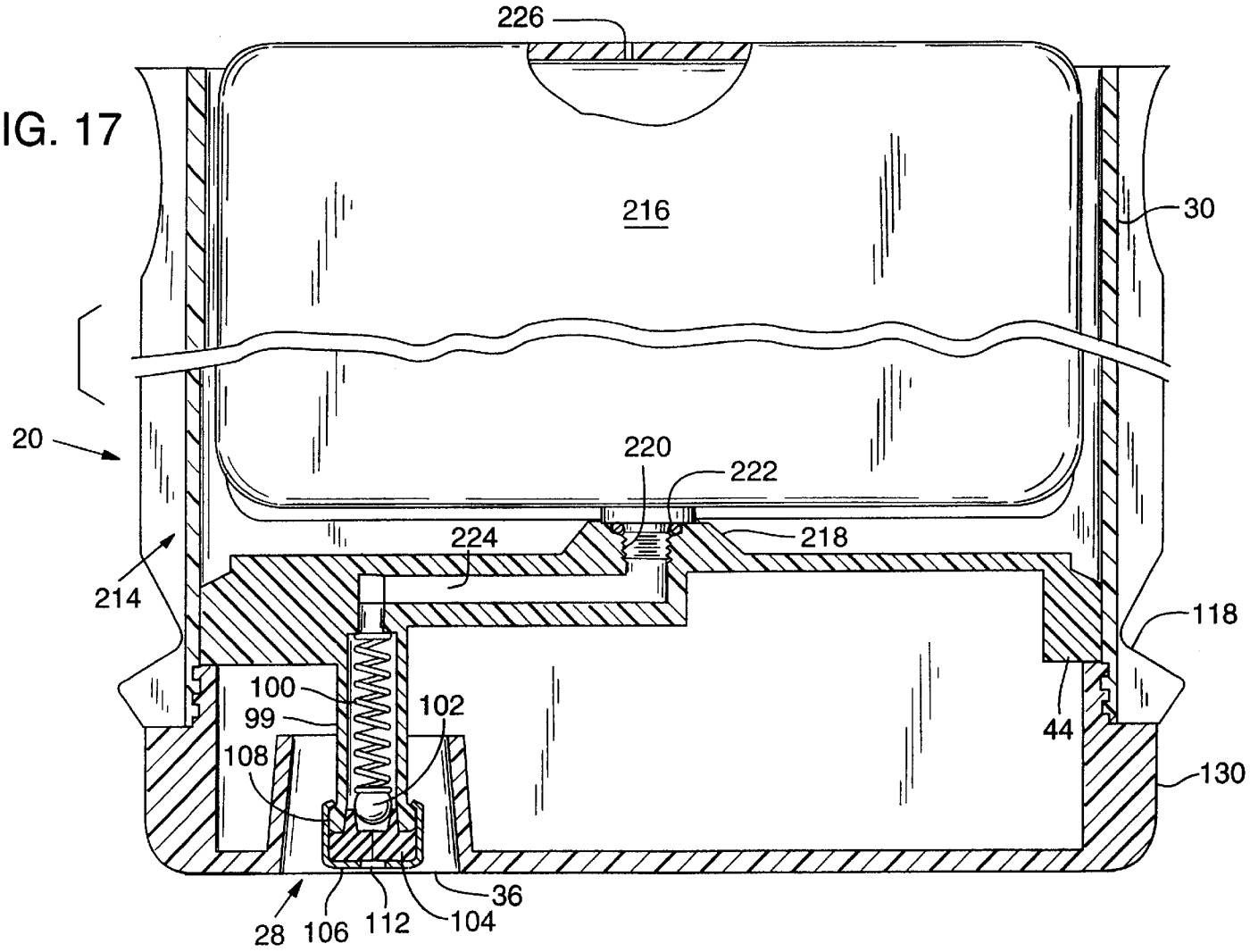
FIG. 17 is a cross sectional view of still another alternative embodiment of an ink supply in accordance with the present invention.

FIG. 17 illustrates another embodiment without a pump 26 in which the reservoir is connected, by threads or some similar mechanism, to a fitment 218 in communication with the fluid outlet 28.

This detailed description is set forth only for purposes of illustrating examples of the present invention and should not be considered to limit the scope thereof in any way. Clearly, numerous additions, substitutions, and other modifications can be made to the invention without departing from the scope of the invention. For example, existing ink supplies could be altered or retrofitted to be refillable in accordance with the principles of the present invention. There are a wide variety of modifications or variations, only a few of which are illustrated here, which could be used to implement the present invention which is defined in the appended claims and equivalents thereof.

What is claimed is:

1. A refillable ink supply for removable insertion into a docked position within a docking bay of an ink-jet printer, the docking bay having a pump actuator and a fluid inlet coupled to a trailing tube for supplying ink to a movable print head, the ink supply comprising:

a chassis;

a reservoir coupled to the chassis for containing a quantity of ink, the reservoir defining a refill port into which ink may be introduced into the reservoir;

a cap for the refill port, the cap being selectively removable by a user to add ink to the reservoir;

a fluid outlet carried on the chassis for engaging the fluid inlet when the ink supply is in the docked position; and an ink pump integral with the chassis in fluid communication with the reservoir and the fluid outlet, the pump actuable by the actuator when the ink supply is in the docked position to draw ink from the reservoir and supply the ink through the fluid outlet to the trailing tube.

2. The refillable ink supply of claim 1 in which the reservoir is defined by a rigid frame extending from the chassis and at least one flexible wall attached to the rigid frame.

3. The refillable ink supply of claim 2 in which the refill port is defined by the frame.

4. The refillable ink supply of claim 3 in which the cap is provided with threads for threading into the refill port.

5. The refillable ink supply of claim 1 in which the reservoir is defined by a shell attached to the chassis.

6. The refillable ink supply of claim 5 in which the refill port is defined by the shell.

7. The refillable ink supply of claim 6 in which the cap is provided with threads for threading into the refill port.

8. A replaceable ink supply for insertion into a docked position within a docking bay of an ink-jet printer, the docking bay having a pump actuator and a fluid inlet in fluid communication with a trailing tube for supplying ink to a movable print head, the ink supply comprising:

an adapter insertible into an inserted position in the docking bay of the ink-jet printer, the adapter having an integral ink pump for actuation by the pump actuator and a fluid outlet for coupling with the fluid inlet when in the inserted position, the adapter further carrying a fitment;

an ink reservoir for containing a quantity of ink removably connected to the fitment whereby the adapter is located intermediate the docking bay and the ink reservoir.

9. A replaceable ink supply for insertion into a docked position within a docking bay of an ink-let printer, the docking bay having a pump actuator and a fluid inlet in fluid communication with a trailing tube for supplying ink to a movable print head, the ink supply comprising:

an adapter insertible into an inserted position in the docking bay of the ink-jet printer, the adapter carrying a pump for actuation by the pump actuator and a fluid outlet for coupling with the fluid inlet when in the inserted position, the adapter further carrying a fitment;

an ink reservoir for containing a quantity of ink removably connected to the fitment; and in which the fitment further comprises a threaded opening in fluid communication with the pump and the ink reservoir further comprises a threaded neck that can be removably threaded into the fitment to establish fluid communication between the reservoir and the pump.

10. The replaceable ink supply of claim 8 further comprising a tube having one end attached to the fitment and the other end attached to the ink reservoir, the tube providing for fluid communication between the reservoir and the pump.

11. A replaceable ink supply for insertion into a docked position within a docking bay of an ink-jet printer, the docking bay having a pump actuator and a fluid inlet in fluid communication with a trailing tube for supplying ink to a movable print head, the ink supply comprising:

an adapter insertible into an inserted position in the docking bay of the ink-jet printer, the adapter carrying a fluid outlet for coupling with the fluid inlet when in the inserted position, the adapter further carrying a fitment;

an ink reservoir for containing a quantity of ink removably connected to the fitment whereby the adapter is located intermediate the docking bay and the ink reservoir.

12. A replaceable ink supply for insertion into a docked position within a docking bay of an ink-jet printer, the docking bay having a pump actuator and a fluid inlet in fluid communication with a trailing tube for supplying ink to a movable print head, the ink supply comprising:

an adapter insertible into an inserted position in the docking bay of the ink-jet printer, the adapter carrying a fluid outlet for coupling with the fluid inlet when in the inserted position, the adapter further carrying a fitment;

an ink reservoir for containing a quantity of ink removably connected to the fitment; and in which the fitment further comprises a threaded opening in fluid communication with the fluid outlet and the ink reservoir further comprises a threaded neck that can be removably threaded into the fitment to establish fluid communication between the reservoir and the fluid outlet.

13. The replaceable ink supply of claim 11 further comprising a tube having one end attached to the fitment and the other end attached to the ink reservoir, the tube providing for fluid communication between the reservoir and the fluid outlet.

14. The replaceable ink supply of claim 11 in which the adapter further comprises a mechanism for engaging the actuator when the adapter is in the inserted position.

15. A replaceable ink supply for insertion into a docked position within a docking bay of an ink-jet printer, the docking bay having a fluid inlet in fluid communication with a trailing tube for supplying ink to a movable print head, the ink supply comprising:

an adapter insertible into an inserted position in the docking bay of the ink-jet printer, the adapter carrying a fluid outlet for coupling with the fluid inlet when in the inserted position, the adapter further carrying a fitment;

an ink reservoir for containing a quantity of ink removably connected to the fitment.

16. A replaceable ink supply for insertion into a docked position within a docking bay of an ink-jet printer, the docking bay having a fluid inlet in fluid communication with a trailing tube for supplying ink to a movable print head, the ink supply comprising:

an adapter insertible into an inserted position in the docking bay of the ink-jet printer, the adapter carrying a fluid outlet for coupling with the fluid inlet when in the inserted position, the adapter further carrying a fitment;

an ink reservoir for containing a quantity of ink removably connected to the fitment; and in which the fitment further comprises a threaded opening in fluid communication with the pump and the ink reservoir further comprises a threaded neck that can be removably threaded into the fitment to establish fluid communication between the reservoir and the trailing tube.

17. The replaceable ink supply of claim 15 further comprising a tube having one end attached to the fitment and the other end attached to the ink reservoir, the tube providing for fluid communication between the reservoir and the trailing tube.

* * * * *